US010339906B2

(12) United States Patent
Espeleta et al.

(10) Patent No.: US 10,339,906 B2
(45) Date of Patent: Jul. 2, 2019

(54) MUSICAL COMPOSITION AUTHORING ENVIRONMENT INTEGRATED WITH SYNTHETIC MUSICAL INSTRUMENT

(71) Applicant: SMULE, INC., San Francisco, CA (US)

(72) Inventors: Charles Espeleta, San Francisco, CA (US); Jeannie Yang, San Francisco, CA (US); Perry R. Cook, Jacksonville, OR (US); Oscar Corral, San Ramon, CA (US); Jonathan Moody, San Mateo, CA (US); Ran Xie, San Francisco, CA (US); Jeffrey C. Smith, Atherton, CA (US); Dean Schaffer, San Francisco, CA (US)

(73) Assignee: Smule, Inc., San Francisco, CA (US)

( * ) Notice: Subject to any disclaimer, the term of this patent is extended or adjusted under 35 U.S.C. 154(b) by 0 days.

(21) Appl. No.: 15/667,372

(22) Filed: Aug. 2, 2017

(65) Prior Publication Data

US 2018/0151161 A1 May 31, 2018

Related U.S. Application Data

(60) Provisional application No. 62/370,127, filed on Aug. 2, 2016.

(51) Int. Cl.
*A63H 5/00* (2006.01)
*G04B 13/00* (2006.01)
(Continued)

(52) U.S. Cl.
CPC ..... *G10H 1/0016* (2013.01); *G10H 1/32* (2013.01); *G10H 1/361* (2013.01); *G10H 1/368* (2013.01);
(Continued)

(58) Field of Classification Search
CPC ..... G10H 1/0016; G10H 1/368; G10H 1/32; G10H 1/361; G10H 2210/091;
(Continued)

(56) References Cited

U.S. PATENT DOCUMENTS 6,307,139 B1 * 10/2001 Iwamura ..... G06F 17/30743 84/601
8,222,507 B1 * 7/2012 Salazar ..... G10H 1/0008 84/602
(Continued)

*Primary Examiner* — Jeffrey Donels
(74) *Attorney, Agent, or Firm* — Haynes and Boone, LLP

(57) ABSTRACT

Advanced, but user-friendly composition and editing environments for musical scores may be provided using the types, and in some cases the instances, of computing devices that will in turn consume musical score content so generated. Indeed, by integrating musical composition facilities within synthetic musical instruments that can be widely deployed on hand-held or portable computing devices, a social music network that includes such synthetic musical instruments gains access to a large, and potentially prolific, population of authors, editors and reviewers, as well as to the community-sourced musical scores that they can generate. By curating such content and/or by applying crowd-sourcing or other computational techniques to maintain quality, a social music network may rapidly deploy the new and ever evolving content that its user community desires.

31 Claims, 24 Drawing Sheets

Figure 1:
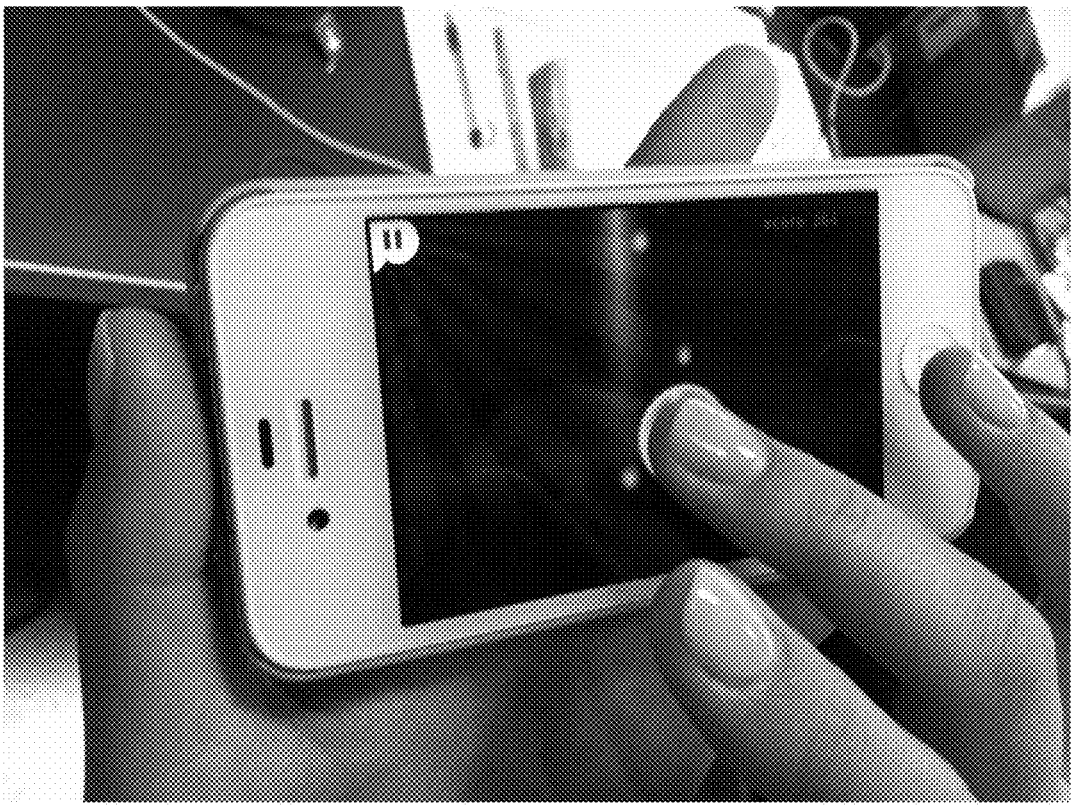

(51) Int. Cl.
*G10H 1/00* (2006.01)
*G10H 1/32* (2006.01)
*G10H 1/36* (2006.01)

(52) U.S. Cl.
CPC . *G10H 2210/091* (2013.01); *G10H 2210/555* (2013.01); *G10H 2210/571* (2013.01); *G10H 2220/096* (2013.01); *G10H 2220/151* (2013.01); *G10H 2220/161* (2013.01); *G10H 2220/201* (2013.01); *G10H 2240/075* (2013.01); *G10H 2240/175* (2013.01)

(58) Field of Classification Search
CPC ..... G10H 2220/151; G10H 2240/175; G10H 2220/201; G10H 2220/096; G10H 2210/555; G10H 2210/571; G10H 2220/161; G10H 2240/075
USPC ..... 84/609
See application file for complete search history.

(56) References Cited

U.S. PATENT DOCUMENTS 8,962,964 B2 * 2/2015 Emmerson ..... G10H 1/0025 84/600
9,082,380 B1 * 7/2015 Hamilton ..... G10H 1/368
9,620,095 B1 * 4/2017 Hamilton ..... G10H 1/368
9,640,158 B1 * 5/2017 Baker ..... G10H 1/0008
9,866,731 B2 * 1/2018 Godfrey ..... H04N 5/04
9,911,403 B2 * 3/2018 Sung ..... G10H 1/368
9,934,772 B1 * 4/2018 Yoelin ..... G10H 1/366
2007/0022865 A1 * 2/2007 Nishibori ..... G10H 1/0016 84/609
2012/0174736 A1 * 7/2012 Wang ..... G10H 1/0008 84/622
2012/0269344 A1 * 10/2012 VanBuskirk ..... H04K 1/00 380/255
2013/0180385 A1 * 7/2013 Hamilton ..... G10H 1/0016 84/603
2013/0233155 A1 * 9/2013 Little ..... G10H 1/0016 84/609
2013/0305905 A1 * 11/2013 Barkley ..... G10H 1/0025 84/609
2014/0039883 A1 * 2/2014 Yang ..... G10H 1/366 704/207
2014/0076126 A1 * 3/2014 Terry ..... G10H 1/34 84/609
2014/0140536 A1 * 5/2014 Serletic, II ..... G06F 3/0481 381/98
2014/0349761 A1 * 11/2014 Kruge ..... A63F 13/814 463/35
2015/0066780 A1 * 3/2015 Cohen ..... G06Q 10/101 705/300
2015/0154562 A1 * 6/2015 Emmerson ..... G06Q 10/101 705/59
2016/0124559 A1 * 5/2016 Linn ..... G10H 1/0066 345/173
2017/0011724 A1 * 1/2017 Cook ..... G10H 1/368
2017/0019471 A1 * 1/2017 Nickelson, II ..... H04L 67/1095
2017/0287457 A1 * 10/2017 Vorobyev ..... G10H 1/0033
2018/0151161 A1 * 5/2018 Espeleta ..... G10H 1/368

* cited by examiner

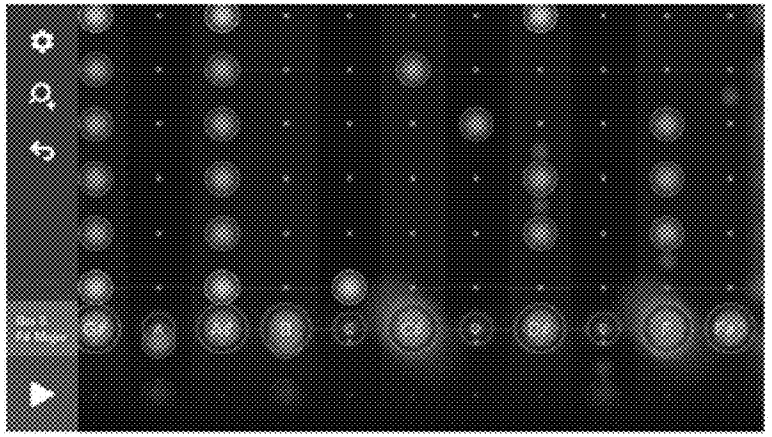
Easily switch between Chromatic and Diatonic keyboards
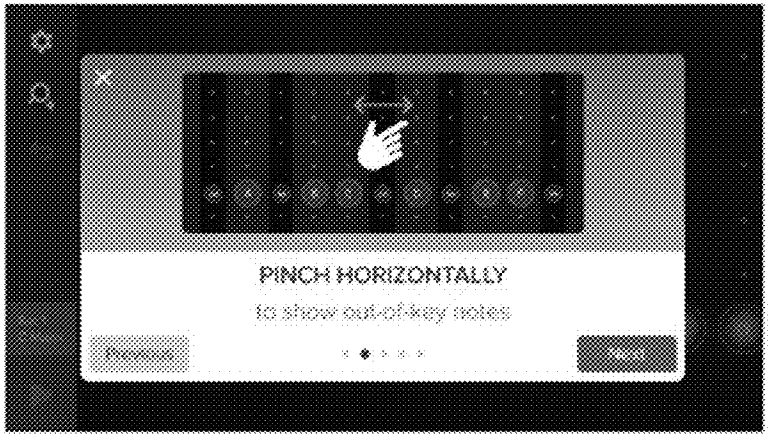
diatonic & chromatic keyboards
FIG. 7 zoom in and out of time
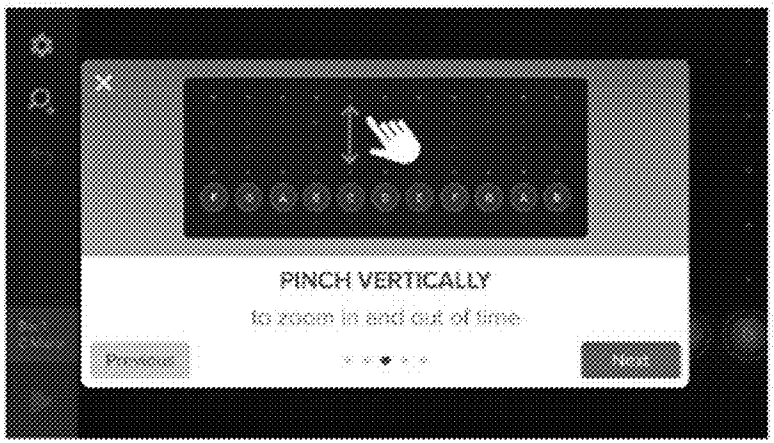
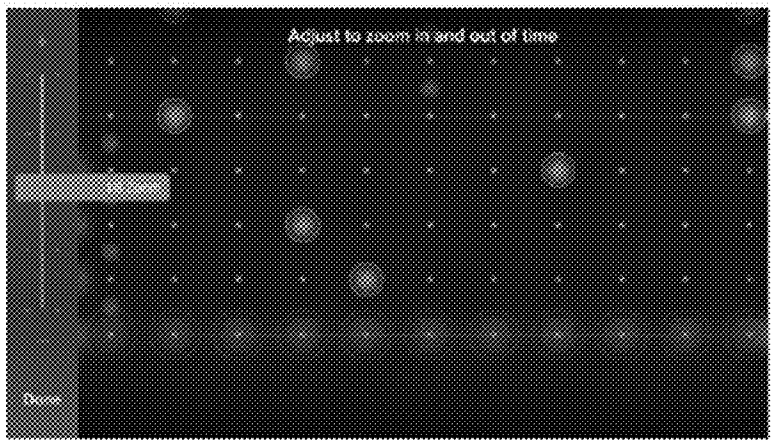
slide from 1/4 to 1/32 time
FIG. 9

Composer Pegboard View

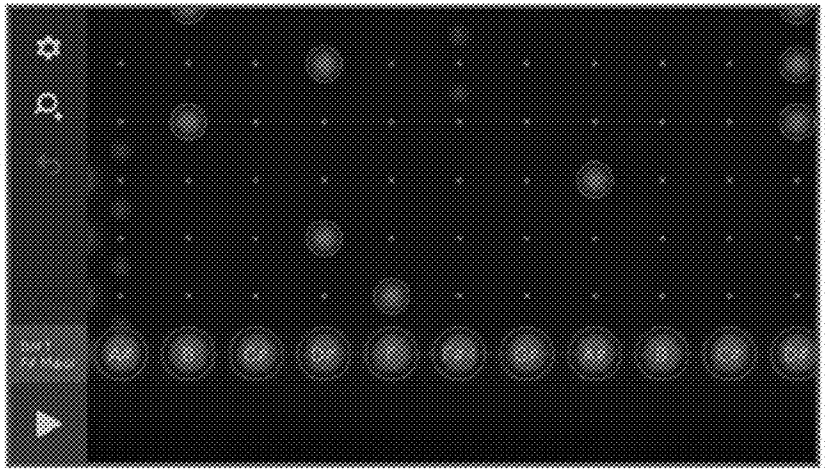

This is the primary composer view where the user places the notes for the song

- User can tap anywhere to place a note.
- User can tap on a note to remove it.
- User can slide the pegboard left and right to see different octaves of the scale.
- User can slide the pegboard up and down to move between different measures of the song.
- The circles with the note names in them is called the "keyboard".
- Users can tap and hold on a note on the keyboard to hear its sound without placing the note. If the user does a quick tap on a note on the keyboard, it will place the note and advance the pegboard.
- User can tap on the "play" button on the bottom left to have the composition autoplay.

FIG. 10

Composer Pegboard View
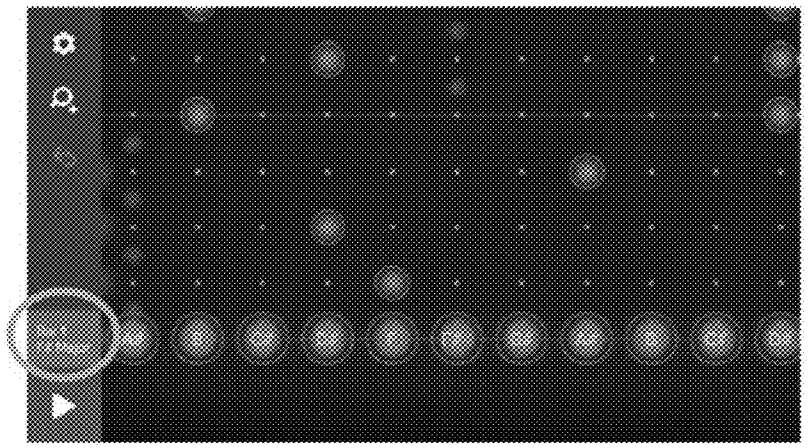
- This shows the Bar # and the key signature.
- User can swipe up and down on this to move between bars.
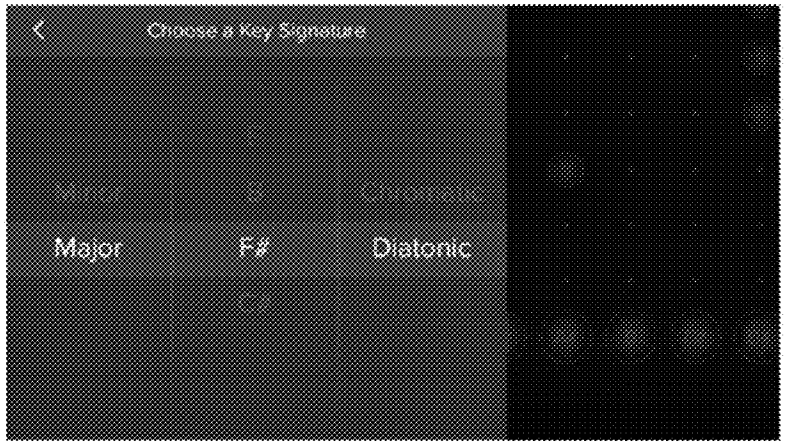
- Users can tap on the bar # to change the key signature.
FIG. 11 quick zoom to bar view

Composer Settings View
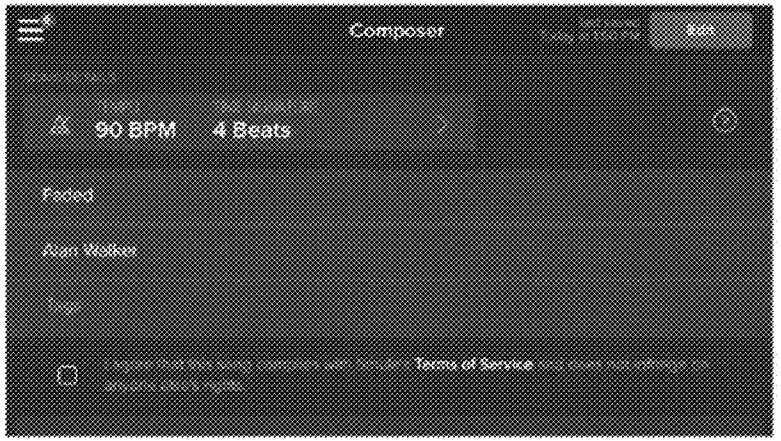
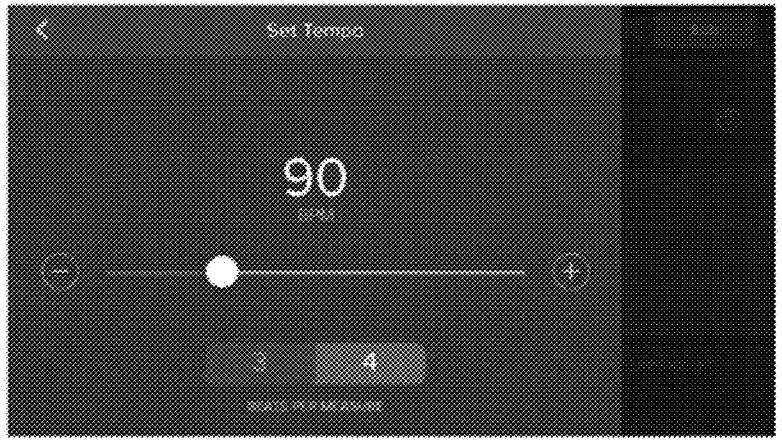
- This is where the users can setup basic information about the composition
- User enters title, artist name and any tags
- User can set tempo and time signature
FIG. 16

Composer Preview & Publish mode
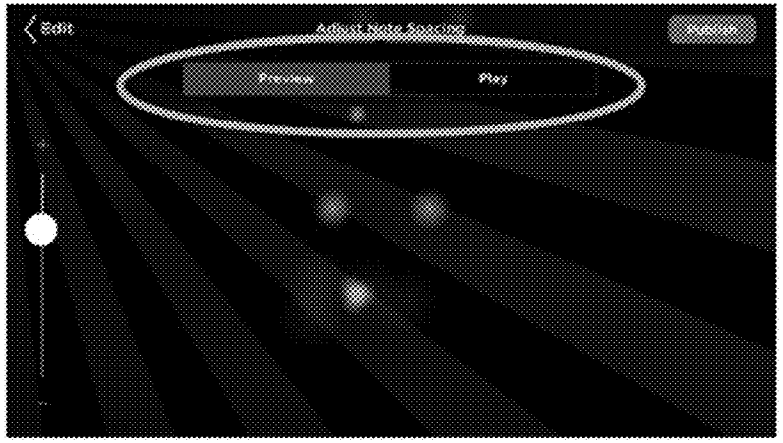
- In preview & publish mode, user can auto-preview or play the song as it would appear in Magic Piano.
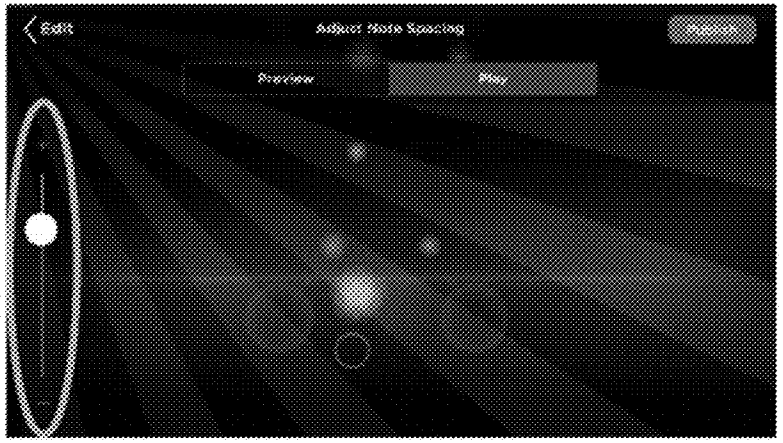
- User can adjust the note spacing for how closely notes would fall in Magic Piano.
FIG. 20

Published song in Magic Piano

- Once the user publishes the song, it appears in the Magic Piano songbook.
- Any users can now search and find the song to play in Magic Piano just like any other song.
- The composer's profile is shown on the song. Users can tap on the composer profile to see list of songs the user has composed.

Published song in Magic Piano
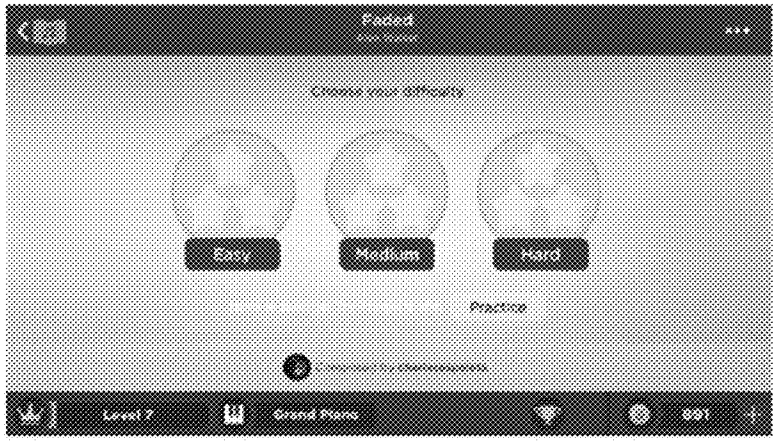
- Once the user publishes the song, it appears in the Magic Piano songbook.
- Any users can now search and find the song to play in Magic Piano just like any other song.
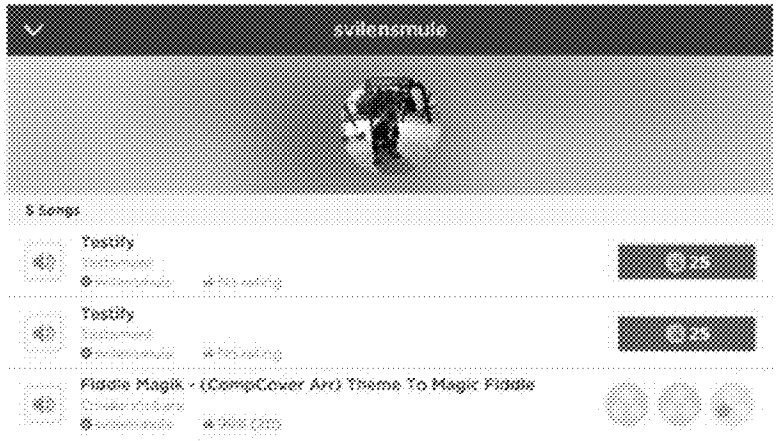
- The composer's profile is shown on the song. Users can tap on the composer profile to see list of songs the user has composed.
FIG. 23

MUSICAL COMPOSITION AUTHORING ENVIRONMENT INTEGRATED WITH SYNTHETIC MUSICAL INSTRUMENT

CROSS-REFERENCE TO RELATED APPLICATION(S)

The present application claims priority under 35 U.S.C. § 119(e) of U.S. application Ser. No. 62/370,127, filed Aug. 2, 2016, the entirety of which is incorporated by reference herein.

BACKGROUND

Field of the Invention

The invention relates generally to composition of musical scores and, in particular, to techniques suitable for facilitating generation of community-sourced musical score content using a large social network of synthetic musical instruments.

Description of the Related Art

The installed base of mobile phones, personal media players, and portable computing devices, together with media streamers and television set-top boxes, grows in sheer number and computational power each day. Hyper-ubiquitous and deeply entrenched in the lifestyles of people around the world, many of these devices transcend cultural and economic barriers. Computationally, these computing devices offer speed and storage capabilities comparable to engineering workstation or workgroup computers from less than ten years ago, and typically include powerful media processors, rendering them suitable for real-time sound synthesis and other musical applications. Indeed, some modern devices, such as iPhone®, iPad®, iPod Touch® and other iOS® or Android devices, support audio and video processing quite capably, while at the same time providing platforms suitable for advanced user interfaces.

Applications such as the Smule Ocarina™, Leaf Trombone®, I Am T-Pain™, AutoRap®, Sing! Karaoke™, Guitar! By Smule®, and Magic Piano® apps available from Smule, Inc. have shown that advanced digital acoustic techniques may be delivered using such devices in ways that provide compelling musical experiences. However, user experience with such applications can be affected not only by the sophistication of digital acoustic techniques implemented, but also by the breadth, variety and quality of content available to support their advanced features. Musial scores are an important component of that content but, unfortunately, can be labor intensive to generate and timely publish, particularly when considering the large numbers of new musical performances that may be released and popularized each week for certain musical genres such as pop music.

To enhance the breadth, variety, and timely incorporation of high-quality musical content into a library made available in a social music network or content repository, computational system techniques are desired that can empower large user networks to create and refine at least some musical content that the advanced digital acoustic applications rely upon. In particular, techniques are desired to facilitate the generation of community- or even crowd-sourced musical score content.

SUMMARY

It has been discovered that advanced, but user-friendly composition and editing environments may be provided using the very computing devices that will, in turn consume musical score content. Indeed, by integrating musical composition facilities within synthetic musical instruments that can be widely deployed on hand-held or portable computing devices, a social music network that includes such synthetic musical instruments gains access to a large, and potentially prolific, population of authors, editors and reviewers, as well as the community-sourced musical scores that they can generate. By curating such content and/or by applying crowd-sourcing or other computational techniques to maintain quality, a social music network may rapidly deploy the new and ever evolving content that its user community craves.

In some embodiments of the present invention, a synthetic musical instrument includes a portable computing device having a multi-touch sensitive display, a network communications interface and both (i) a musical composition authoring process and (ii) digital synthesis executable thereon to audibly render at an audio interface of the portable computing device coded musical arrangements, including in a course of musical composition authoring by a human user. The musical composition authoring process is executable to present on the multi-touch sensitive display a two-dimensional grid of note soundings wherein musical scale is presented thereon in a first dimension and measure or time is presented in a second dimension generally orthogonal to the first dimension. The coded musical arrangements are conveyed, via the network communications interface, to and from a content server- or service platform-resident songbook to provide community contributed content in a social music network that includes the portable computing device and the human user.

In some cases or embodiments, visual presentation on the multi-touch sensitive display of a particular coded musical arrangement being authored or edited by the human user is in accordance with a current musical scale, and a user interface of the musical composition authoring process supports user interface gestures whereby the human user may, in the course of musical composition authoring, switch between a first musical scale presentation mode and at least a second musical scale presentation mode. In some cases or embodiments, the first dimension is a horizontal dimension and the second dimension is a vertical dimension.

In some cases or embodiments, in the first musical scale presentation mode, the note soundings of the coded musical arrangement are visually presented in accordance with a diatonic scale, while in the second musical scale presentation mode, the note soundings of the coded musical arrangement are visually presented in accordance with a chromatic scale. User interface gestures include generally horizontally-oriented reverse pinch and pinch gestures on the multi-touch sensitive display to reveal and hide additional notes of the chromatic scale.

In some cases or embodiments, the digital synthesis is of piano-type string excitations, wherein the first musical scale is a diatonic scale anchored in a user selectable major or minor key, and wherein the second musical scale is a chromatic scale.

In some embodiments, the synthetic musical instrument further includes a user interface that presents the human user with a play control to trigger, upon selection thereof, the digital synthesis and an audible rendering of a particular coded musical arrangement being authored or edited by the human user.

In some cases or embodiments, a visual presentation of the two-dimensional grid on the multi-touch sensitive display includes a keying band that presents individual key positions in accordance with a current musical scale. In some cases or embodiments, visual presentation of the two-dimensional grid on the multi-touch sensitive display includes a composer pegboard that presents notes sounded or to be sounded in prior measures of a particular coded musical arrangement in correspondence with pegboard positions aligned with a current musical scale. In some cases or embodiments, a user interface of the musical composition authoring process supports user interface gestures on the multi-touch sensitive display whereby generally vertically-oriented reverse pinch and pinch gestures on the multi-touch sensitive display adjust the visual presentation amongst bar and fractionally quantized measures of musical meter.

In some cases or embodiments, a user interface of the musical composition authoring process supports a tap-denominated user interface gesture on the multi-touch sensitive display whereby the human user may insert or delete one or more measures of the coded musical arrangement. In some cases or embodiments, a user interface of the musical composition authoring process supports lateral swiping gesture on the multi-touch sensitive display to shift up and down a current musical scale to reveal higher and lower octaves thereof.

In some embodiments, the synthetic musical instrument is communicatively coupled to the content server- or service platform-resident songbook. In some cases or embodiments, at least some of the coded musical arrangements are MIDI coded.

In some embodiments in accordance with the present invention(s), a system includes a content server- or service platform-resident repository of community contributed musical scores. The repository is coupled via one or more communications networks to define a social music network that includes a plurality of portable computing devices configured as synthetic musical instruments. At least a first one of the synthetic musical instruments includes a multi-touch sensitive display, a network communications interface, and both (i) a musical composition authoring process and (ii) digital synthesis executable thereon to audibly render coded musical arrangements at an audio interface of the portable computing device, including in a course of musical composition authoring by a human user. The musical composition authoring process is executable to present on the multi-touch sensitive display a two-dimensional grid of note soundings, wherein musical scale is presented thereon in a first dimension and measure or time is presented in a second dimension generally orthogonal to the first dimension.

In some cases or embodiments, the synthetic musical instrument is configured to retrieve and post musical score instances from and to the network-coupled repository. The network-coupled repository maintains metadata in association with the musical score instances, wherein for at least some of the musical score instances, the associated metadata includes crowd-sourced rating or ranking data accumulated from postings by respective users of synthetic musical instruments in connection with audible rendering of the particular musical score instance at an audio interface of the respective portable computing device.

In some cases or embodiments, the musical composition authoring process is further executable to support a retrieve/modify/post interaction with the network-coupled repository, and the network-coupled repository maintains versioning metadata at least in correspondence with postings of musical score instances that are modified from a retrieved musical score instance. In some cases or embodiments, the first synthetic musical instrument implements a piano.

In some embodiments, the system further includes at least one non-piano synthetic musical instrument configured to retrieve musical score instances from the community contributed musical scores repository, including musical score instances authored or edited on, and posted by, the first synthetic musical instrument. In some embodiments, the system further includes at least one portable computing device configured for karaoke-style vocal capture and network coupled to retrieve musical score instances from the community contributed musical scores repository, including musical score instances authored or edited on, and posted by, the first synthetic musical instrument.

In some embodiments in accordance with the present inventions, a method includes (1) visually presenting on a multi-touch sensitive display of a portable computing device, a two-dimensional grid of constituent note soundings of a coded musical arrangement, wherein musical scale is presented thereon in a first dimension and measure or time is presented in a second dimension generally orthogonal to the first dimension; (2) in a course of musical composition authoring or revising the coded musical arrangement, digitally synthesizing an audible rendering of at least a portion of the coded musical arrangement at an audio interface of the portable computing device; and (3) posting the authored or revised coded musical arrangement, via a network communications interface of the portable computing device, to a content server- or service platform-resident songbook to provide community contributed content in a social music network that includes the portable computing device.

In some embodiments, the method further includes retrieving, via the network communications interface of the portable computing device, a precursor version of the coded musical arrangement from the content server- or service platform-resident songbook. In some embodiments, the method further includes visually presenting on the multi-touch sensitive display and in accordance with a current musical scale, the coded musical arrangement being authored or edited by a human user; and responsive to user interface gestures of the human user, switching in the course of musical composition authoring, between a first musical scale presentation mode and at least a second musical scale presentation mode. In some cases or embodiments, in the first musical scale presentation mode, the note soundings of the coded musical arrangement are visually presented in accordance with a diatonic scale, whereas, in the second musical scale presentation mode, the note soundings of the coded musical arrangement are visually presented in accordance with a chromatic scale. User interface gestures include reverse pinch and pinch gestures on the multi-touch sensitive display to reveal and hide additional notes of the chromatic scale.

In some cases or embodiments, the digital synthesis is of piano-type string excitations, the first musical scale is a diatonic scale anchored in a user selectable major or minor key, and the second musical scale is a chromatic scale.

In some embodiments, the method further includes presenting the human user with a play control to trigger, upon selection thereof, the digital synthesis and an audible rendering of a particular coded musical arrangement being authored or edited. In some cases or embodiments, the visual presentation of the two-dimensional grid on the multi-touch sensitive display includes a keying band that presents individual key positions in accordance with a current musical scale. In some cases or embodiments, the visual presentation of the two-dimensional grid on the multi-touch sensitive display includes a composer pegboard that presents notes sounded or to be sounded in prior measures of a particular coded musical arrangement in correspondence with pegboard positions aligned with a current musical scale.

In some embodiments, the method further includes adjusting, responsive to generally vertically-oriented reverse pinch and pinch gestures of the human user on the multi-touch sensitive display, the visual presentation amongst bar and fractionally quantized measures of musical meter. In some embodiments, the method further includes inserting or deleting, responsive to a tap-denominated user interface gesture on the multi-touch sensitive display, one or more measures of the coded musical arrangement. In some embodiments, the method further includes shifting up and down a current musical scale to reveal higher and lower octaves thereof in response to a swiping gesture on the multi-touch sensitive display.

In some embodiments of the present invention(s), a musical composition authoring system includes a content server- or service platform-resident repository of community contributed musical scores and a composer client. The repository is coupled via one or more communications networks to define a social music network that includes a plurality of portable computing devices configured as synthetic musical instruments. The composer client includes a retrieval and posting interface to the community-contributed musical scores and is configured to (i) present a human composer with a two-dimensional grid of note sounding positions wherein musical scale is presented thereon in a first dimension and measure or time is presented in a second dimension generally orthogonal to the first dimension and to (ii) overlay on the two-dimensional grid a visual presentation of at least a current window on a coded musical score being authored or edited by the human user.

In some cases or embodiments, the note soundings of the coded musical score are visually presented, in a first mode, in accordance with a diatonic scale and, in a second mode, in accordance with a chromatic scale. In correspondence with transitions between the first and second modes, the composer client reveals and hides additional notes of the chromatic scale.

In some embodiments, the system further includes the synthetic musical instruments and the synthetic musical instruments are configured to retrieve and post musical score instances from and to the network-coupled repository. The network-coupled repository is configured to maintain metadata in association with the musical score instances, wherein for at least some of the musical score instances, the associated metadata includes crowd-sourced rating or ranking data accumulated from postings by respective users of synthetic musical instruments in connection with audible rendering of the particular musical score instance at an audio interface thereof.

In some embodiments, the system further includes a karaoke-style vocal capture device that is network coupled to retrieve musical score instances from the community contributed musical scores repository, including musical score instances authored or edited on, and posted by, the composer client.

In some cases or embodiments, the network-coupled repository is configured to maintain versioning metadata at least in correspondence with postings of musical score instances that are modified from a retrieved musical score instance.

These and other embodiments in accordance with the present invention(s) will be understood with reference to the description and appended claims which follow.

DRAWINGS AND DESCRIPTION

The present invention(s) are illustrated by way of examples and not limitation with reference to the accompanying figures, in which like references generally indicate similar elements or features. Many aspects of the design and operation of a synthetic musical instrument will be understood based on the description herein of certain exemplary piano- or keyboard-type implementations and teaching examples. Nonetheless, it will be understood and appreciated based on the present disclosure that variations and adaptations for other instruments are contemplated. Portable computing device implementations and deployments typical of a social music applications for iOS® and Android® devices are emphasized for purposes of concreteness. However, it will be understood that, at least some aspects of the composer pegboard user interfaces described herein, other compute platforms including desktop applications or browser client may also be suitable.

While synthetic keyboard-type, string and even wind instruments and application software implementations provide a concrete and helpful descriptive framework in which to describe aspects of the invented techniques, it will be understood that Applicant's techniques and innovations are not necessarily limited to such instrument types or to the particular user interface designs or conventions (including e.g., musical score presentations, note sounding gestures, visual cuing, sounding zone depictions, etc.) implemented therein. Indeed, persons of ordinary skill in the art having benefit of the present disclosure will appreciate a wide range of variations and adaptations as well as the broad range of applications and implementations consistent with the examples now more completely described.

Figure 2:
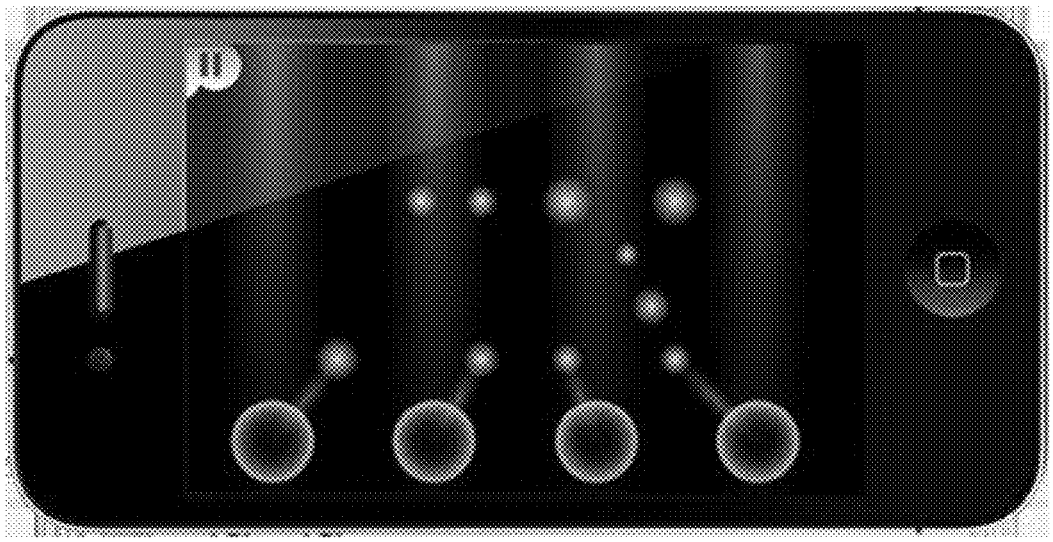

FIGS. 1 and 2 depict performance uses of a portable computing device hosted implementation of a synthetic piano in accordance with some embodiments of the present invention. FIG. 1 depicts an individual performance use, while FIG. 2 depicts note and chord sequences visually cued in accordance with a musical score and sounded by a user whose note sounding gestures (e.g., finger contacts) are not specifically shown so as to avoid obscuring the view.

Figure 3:
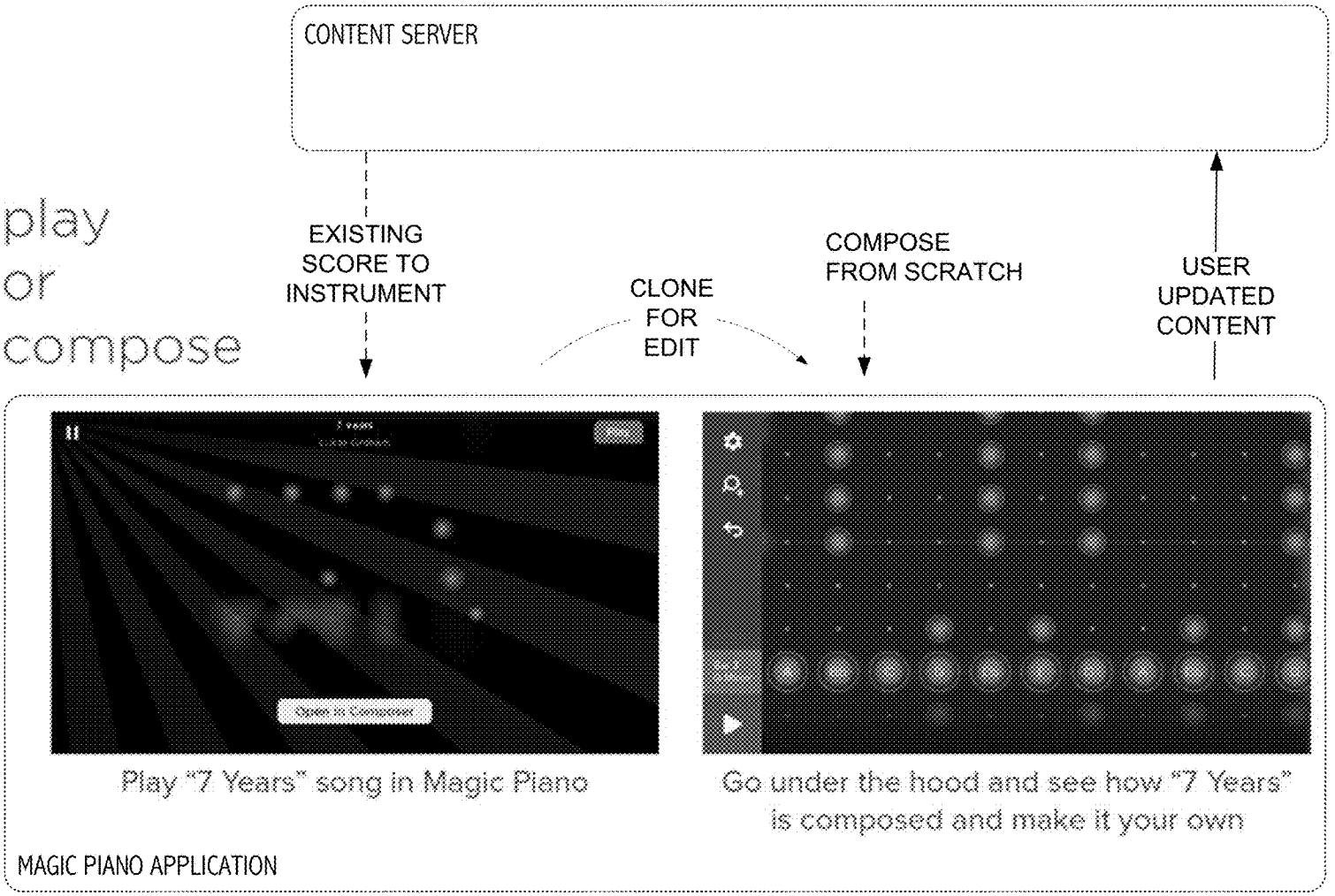

FIG. 3 depicts modes of operation of a synthetic piano application in which an existing musical score may retrieved from a network-connected content server or service and used (i) to drive a digital synthesis and audible rendering and/or (ii) to cue note soundings by a user performer that themselves drive digital synthesis and audible rendering. The synthetic piano application also supports in-app authorship or editing of such a musical score, such that the authored or edited score may, in turn, be uploaded to the network-connected content server or service in accordance with some embodiments of the present invention.

Figure 4A:
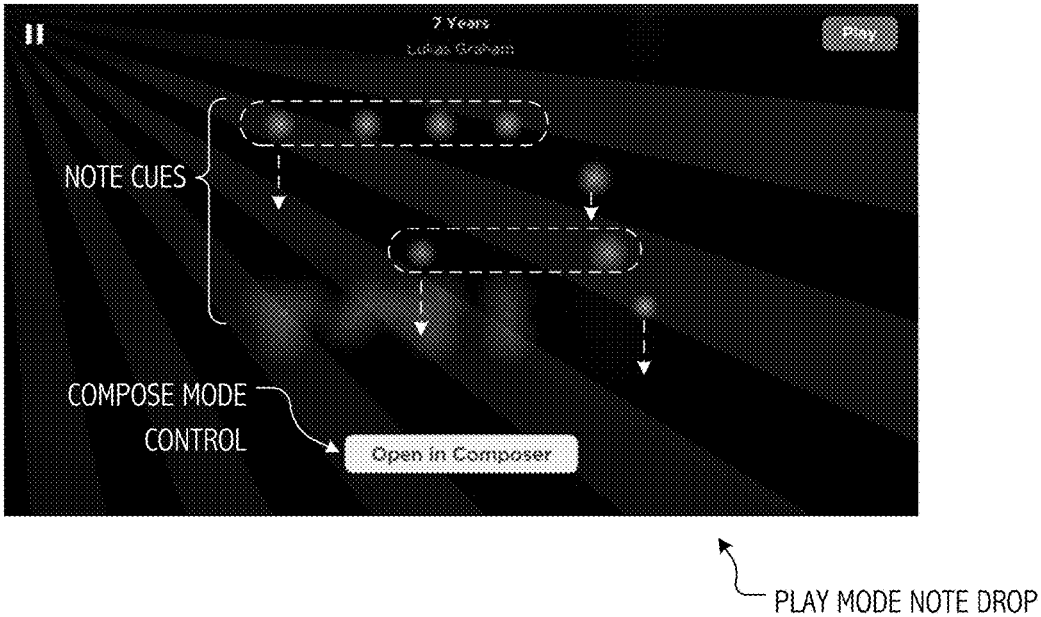
Figure 4B:
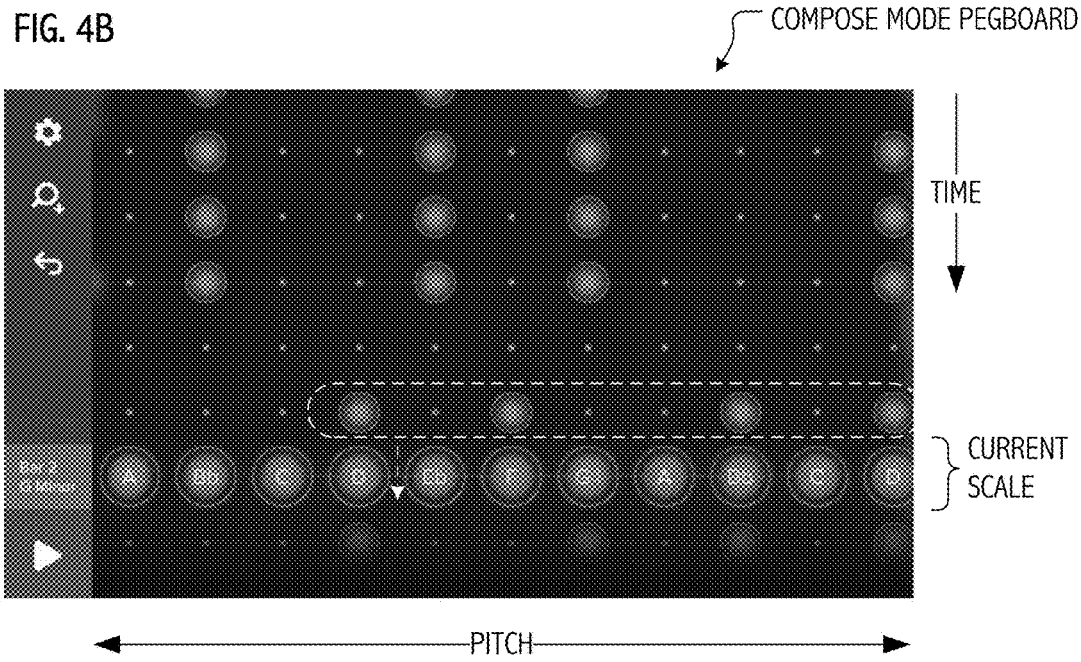

FIGS. 4A and 4B depict respective operational modes of a synthetic piano application. In operational modes exemplified by FIG. 4A, a musical composition is played or cued. In operational modes exemplified by FIG. 4B, a musical composition is authored or edited.

Figure 5:
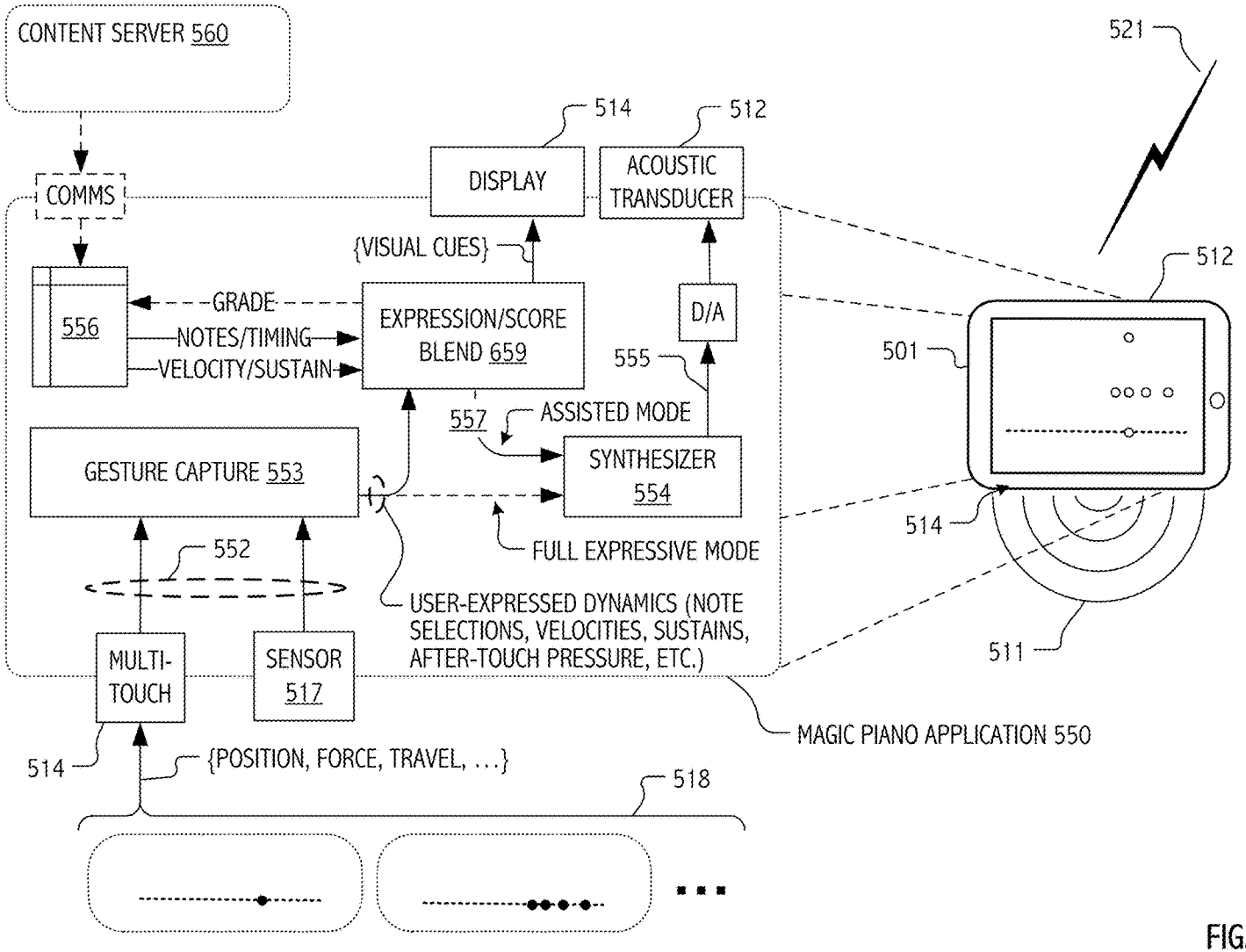

FIG. 5 is a functional block diagram that illustrates performance mode operation of a synthetic piano application executable for capture of user gestures corresponding to a sequence of note and chord soundings of a performance that is visually cued thereon, together with an acoustic rendering of the performance, all in accordance with some embodiments of the present invention. Performance mode operation of an illustrative embodiment in accordance with FIG. 5 is detailed in commonly-owned, Provisional Application No. 62/222,824, filed 24 Sep. 2015, entitled "Synthetic Musical Instrument with Touch Dynamics and/or Expressiveness Control," and naming Cook, Yang, Woo, Shimmin, Leistikow, Berger and Smith as inventors, the entirety of which is incorporated herein by reference.

For purposes of understanding suitable implementations, any of a wide range of digital synthesis techniques may be employed to drive audible rendering of the user musician's performance via a speaker or other acoustic transducer or interface thereto. In general, the audible rendering may include synthesis of tones, overtones, harmonics, perturbations and amplitudes and other performance characteristics based on a captured user gesture stream. Alternatively, or in some cases or modes of operation, audible rendering may be of the current musical composition based on a MIDI-type (Musical Instrument Digital Interface) or other encoding thereof. Note that, when driven by user interface gestures, such as in a performance mode of operation, the digital synthesis can allow the user musician to control (in some embodiments) an actual expressive model using multi-sensor interactions (e.g., finger strikes at note positions on screen, perhaps with sustenance or damping gestures expressed by particular finger travel or via an orientation- or accelerometer-type sensor) as inputs. A variety of computational techniques may be employed and will be appreciated by persons of ordinary skill in the art. For example, exemplary techniques include wavetable or FM synthesis.

Wavetable or FM synthesis is generally a computationally efficient and attractive digital synthesis implementation for piano-type musical instruments such as those described and used herein as primary teaching examples. However, and particularly for adaptations of the present techniques to syntheses of certain types of multi-string instruments (e.g., unfretted multi-string instruments such as violins, violas cellos and double bass), physical modeling may provide a livelier, more expressive synthesis that is responsive (in ways similar to physical analogs) to the continuous and expressively variable excitation of constituent strings. For a discussion of digital synthesis techniques that may be suitable in other synthetic instruments, see generally, commonly-owned co-pending application Ser. No. 13/292,773, filed Nov. 11, 2011, entitled "SYSTEM AND METHOD FOR CAPTURE AND RENDERING OF PERFORMANCE ON SYNTHETIC STRING INSTRUMENT" and naming Wang, Yang, Oh and Lieber as inventors, which is incorporated by reference herein.

Figure 6:
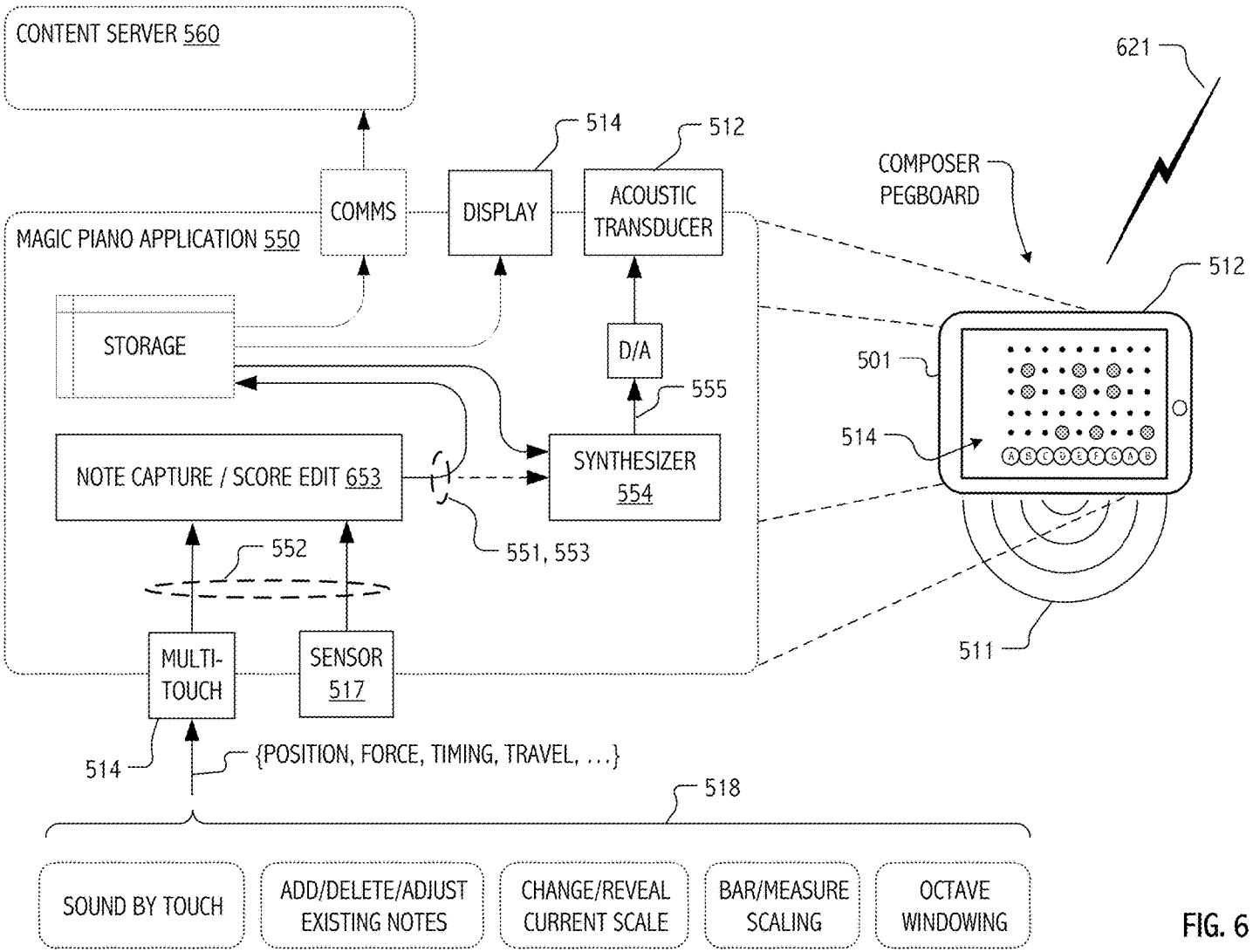

FIG. 6 is a functional block diagram that illustrates musical composition mode operation of the above-described synthetic piano application, including an exemplary composer pegboard user interface design, touchscreen inputs, digital synthesis and network communications thereof, in accordance with some embodiments of the present invention. Further aspects of musical composition mode operations are illustrated in drawings and accompanying description that follows.

Figure 8A:
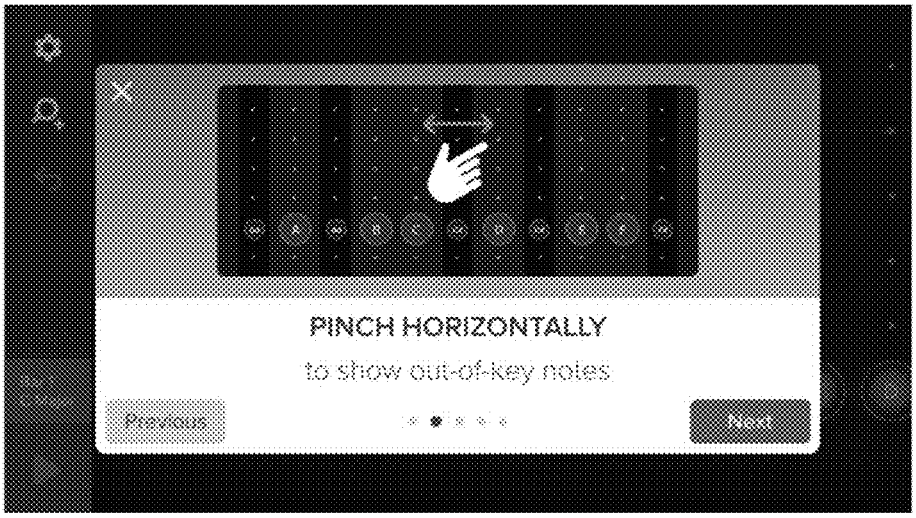
Figure 8B:
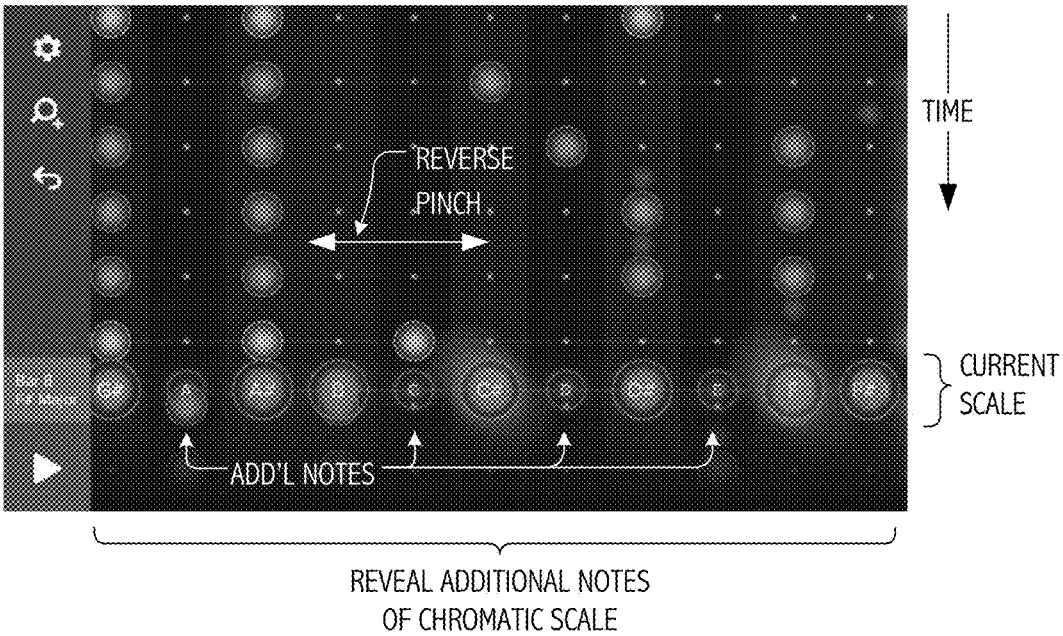
Figure 19:
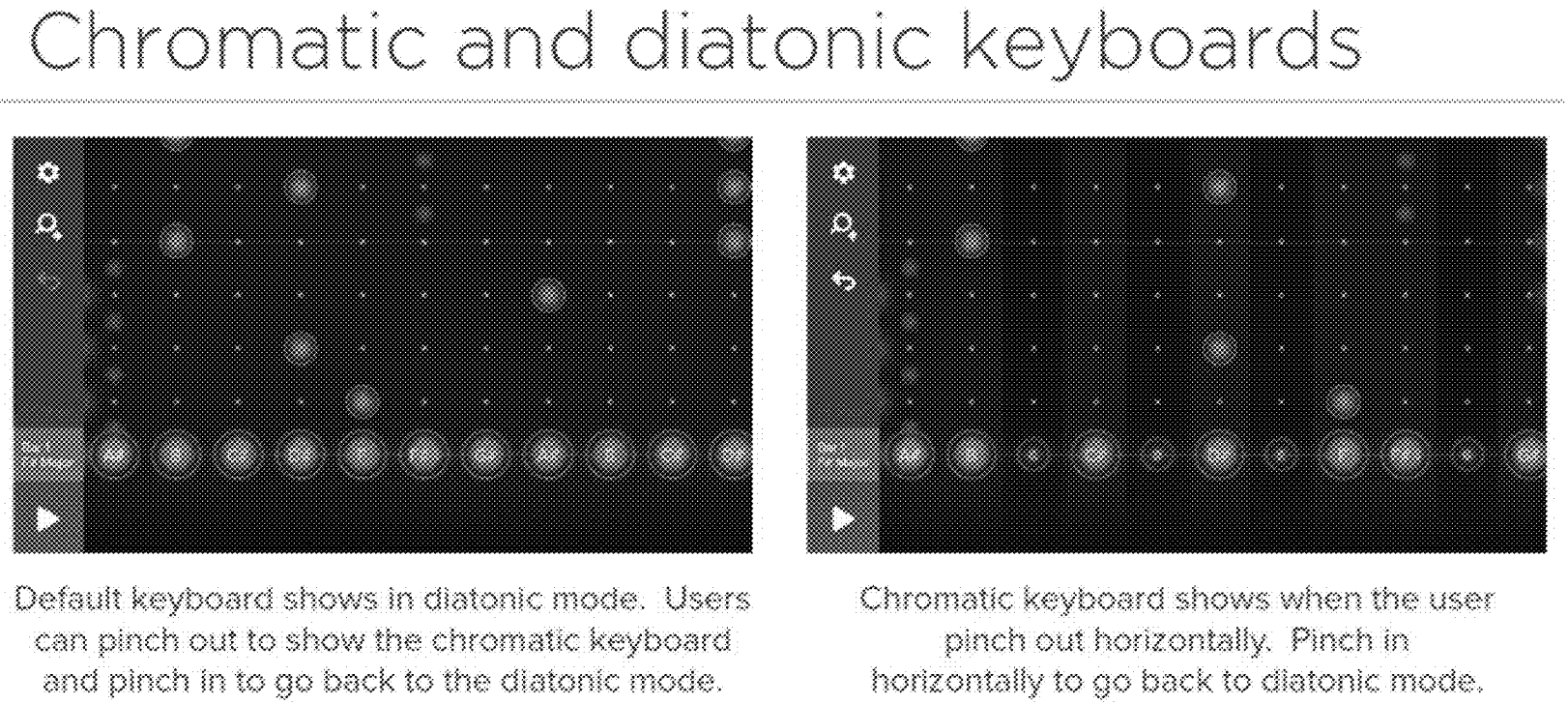

FIGS. 7, 8A and 8B visually depict horizontal reverse pinch/pinch gestures whereby a human user may transition between diatonic and chromatic key signatures to reveal and hide additional notes associated with the chromatic scale. Such gesturing may be supported in musical composition mode operation as well as, in some cases or embodiments, in performance mode operations of a synthetic piano application in accordance with some embodiments of the present invention. FIG. 19 visually depicts, in somewhat greater detail for particular a composer pegboard views, diatonic and chromatic key signatures (or keyboards) at a currently selected F# major scale.

Figure 17:
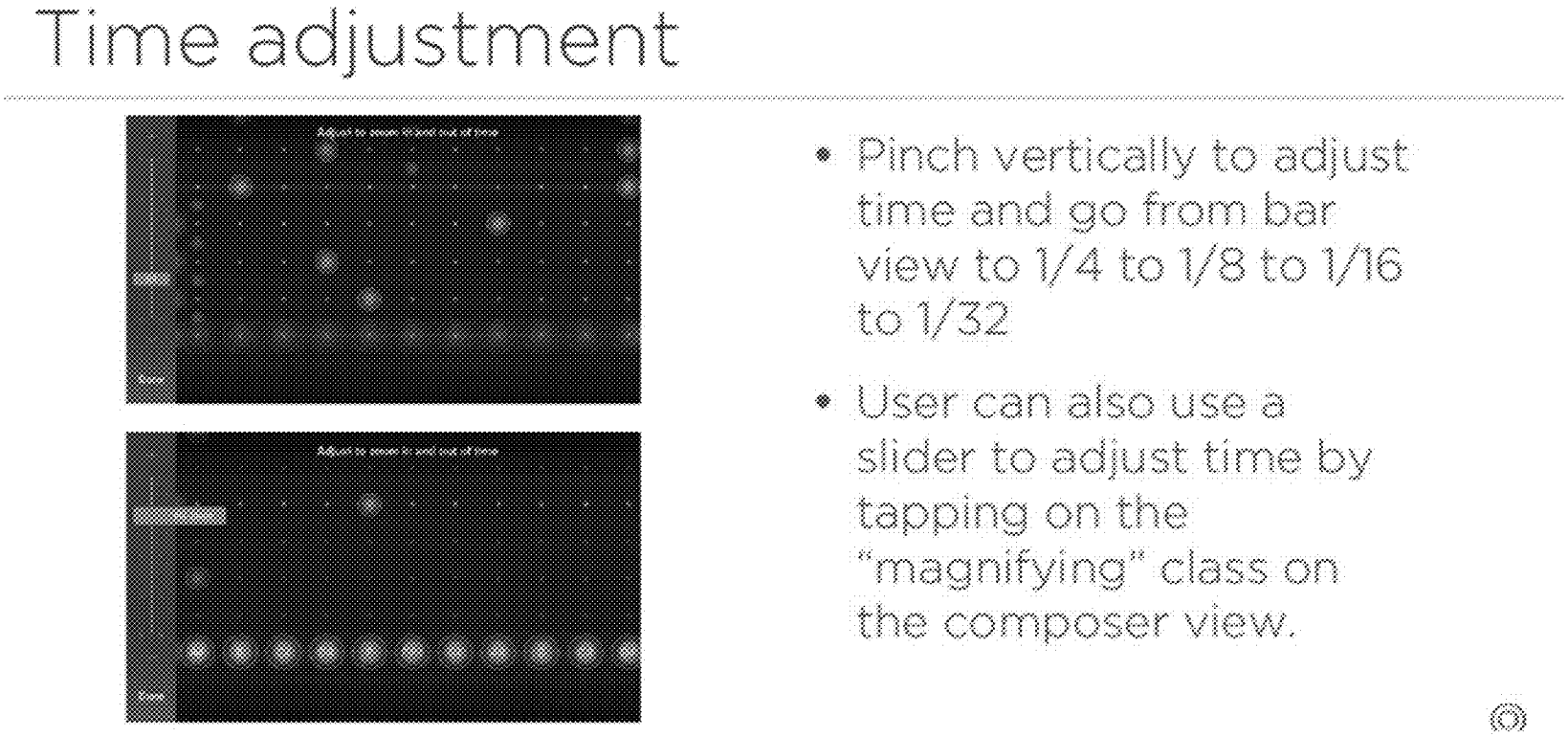

FIG. 9 visually depicts vertical reverse pinch/pinch gestures whereby a human user may adjust the measure or bar (temporal) scale of a depicted musical composition being authored or edited in a musical composition mode operation in accordance with some embodiments of the present invention. FIG. 17 further illustrates temporal scale adjustments, including adjustments facilitated using a vertical slider-type user interface feature. Note that, in the context of FIGS. 7, 8A, 8B, 9, 17 and 19, horizontal and vertical-orientations are for purposes of concrete illustration in the context of specific screen depictions, not limitation.

Figure 12:
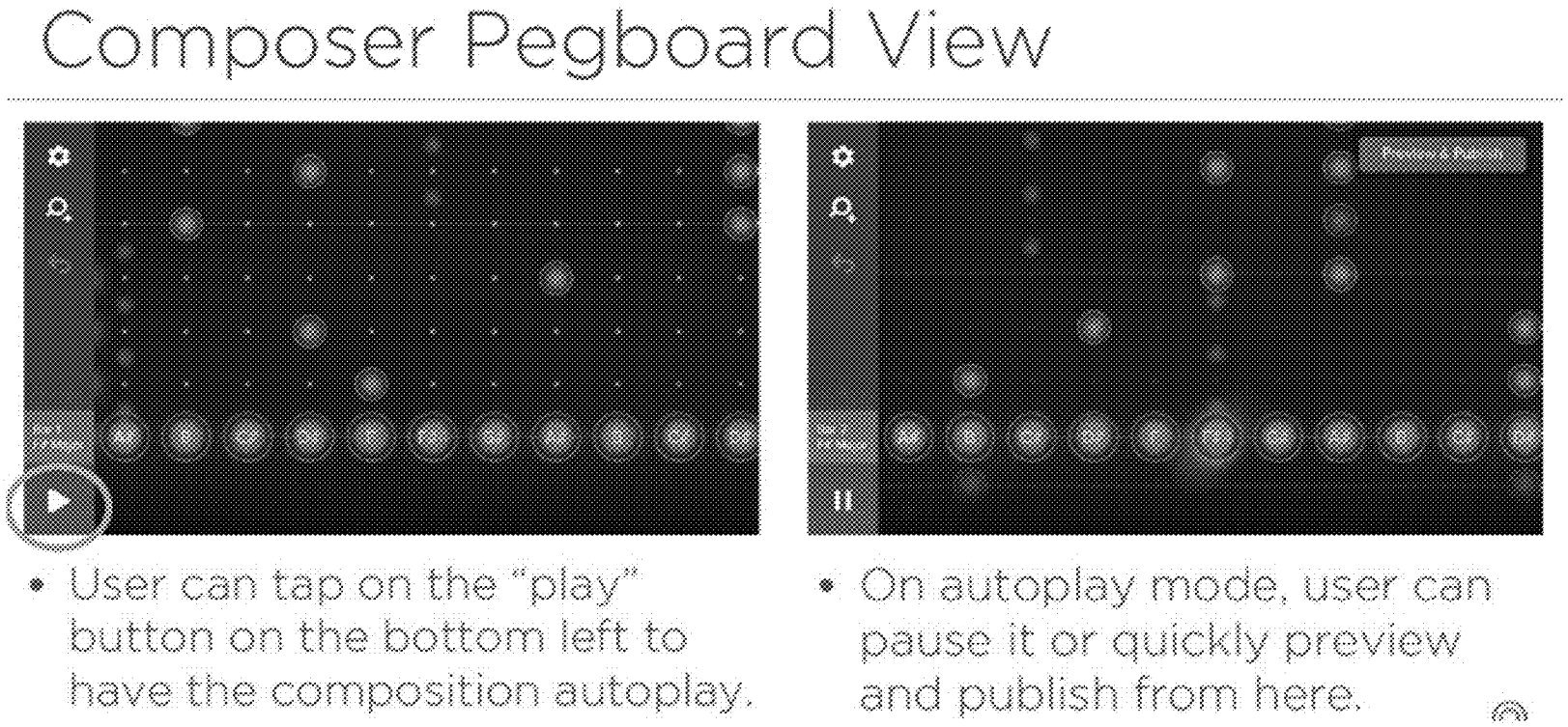
Figure 13:
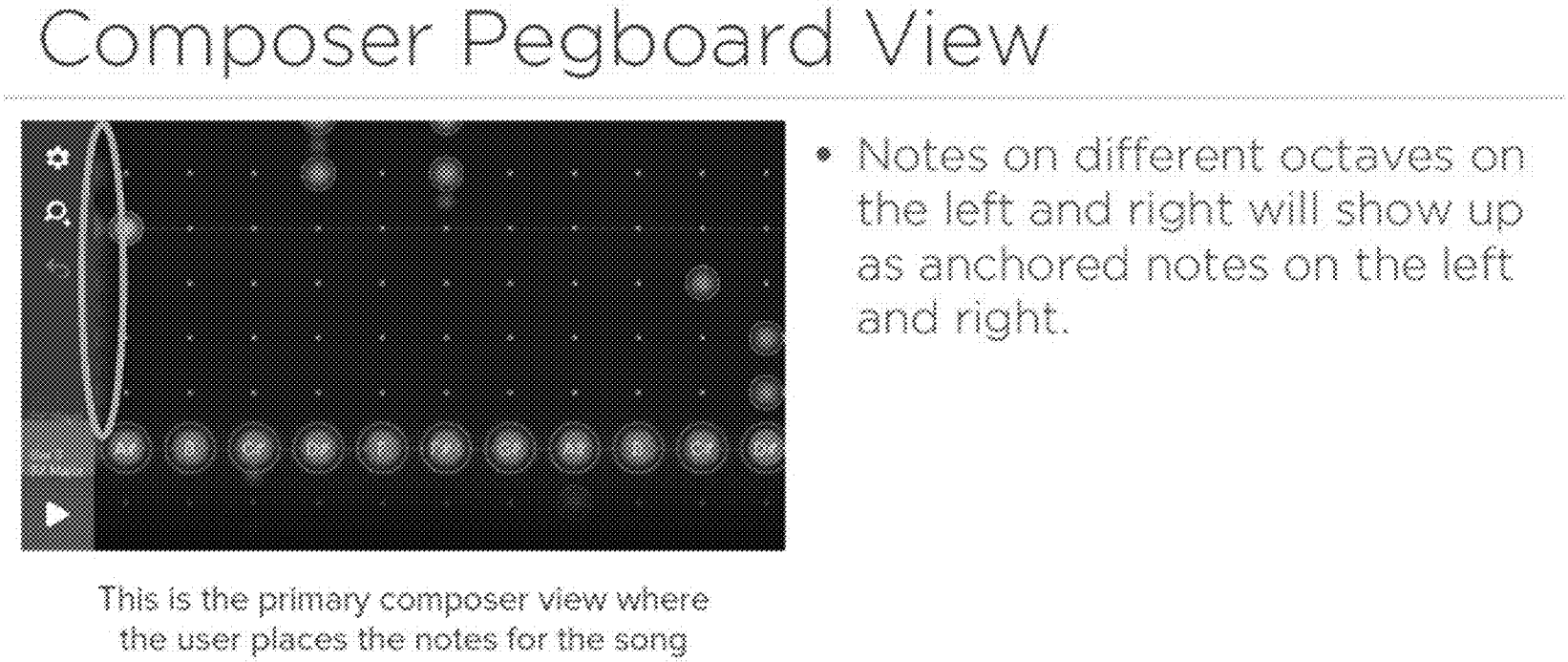

FIG. 10 visually depicts a composer pegboard view of a depicted musical composition being authored or edited in a musical composition mode operation in accordance with some embodiments of the present invention. FIG. 9 also annotates the depiction with descriptions of exemplary user interactions suitable in a touchscreen embodiment, for manipulation, viewing and indeed, triggering of an audible rendering by digital synthesis (play) of the musical composition. FIGS. 11, 12 and 13 depict additional aspects of the composer pegboard view and related operations, including the changing of key signatures for particular bars or measures, playing and pausing digital synthesis/audible rendering, and illustrative symbologies for off-screen notes and octaves.

Figure 14:
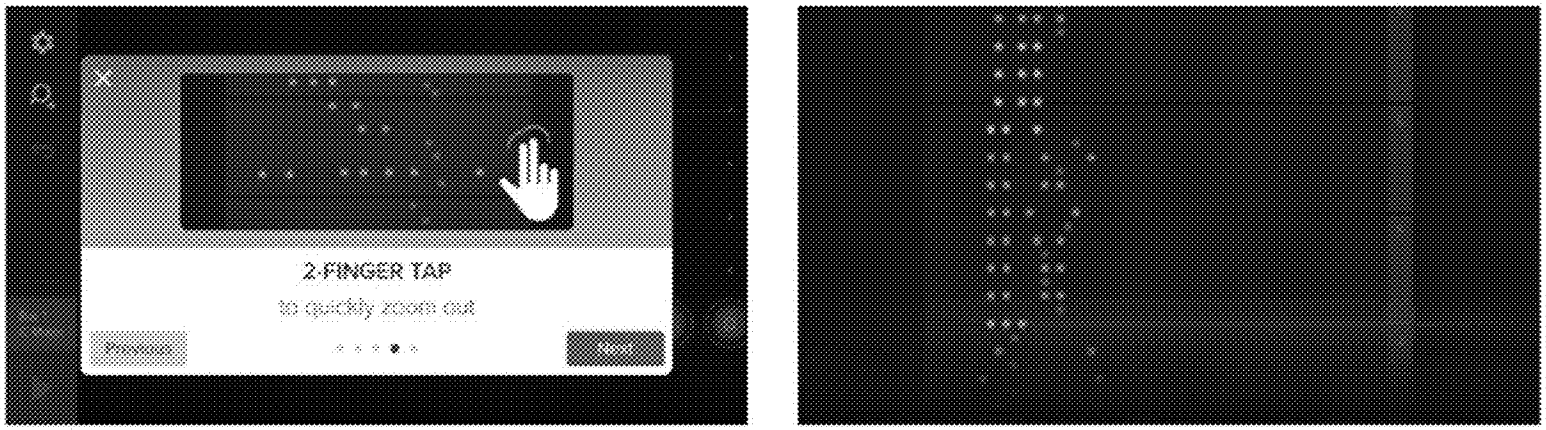
Figure 15:
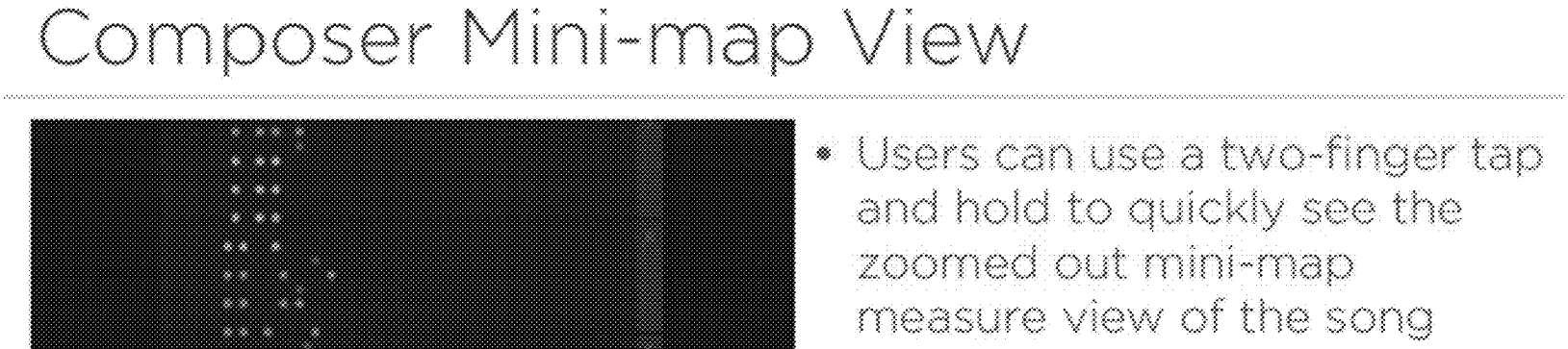
Figure 18:
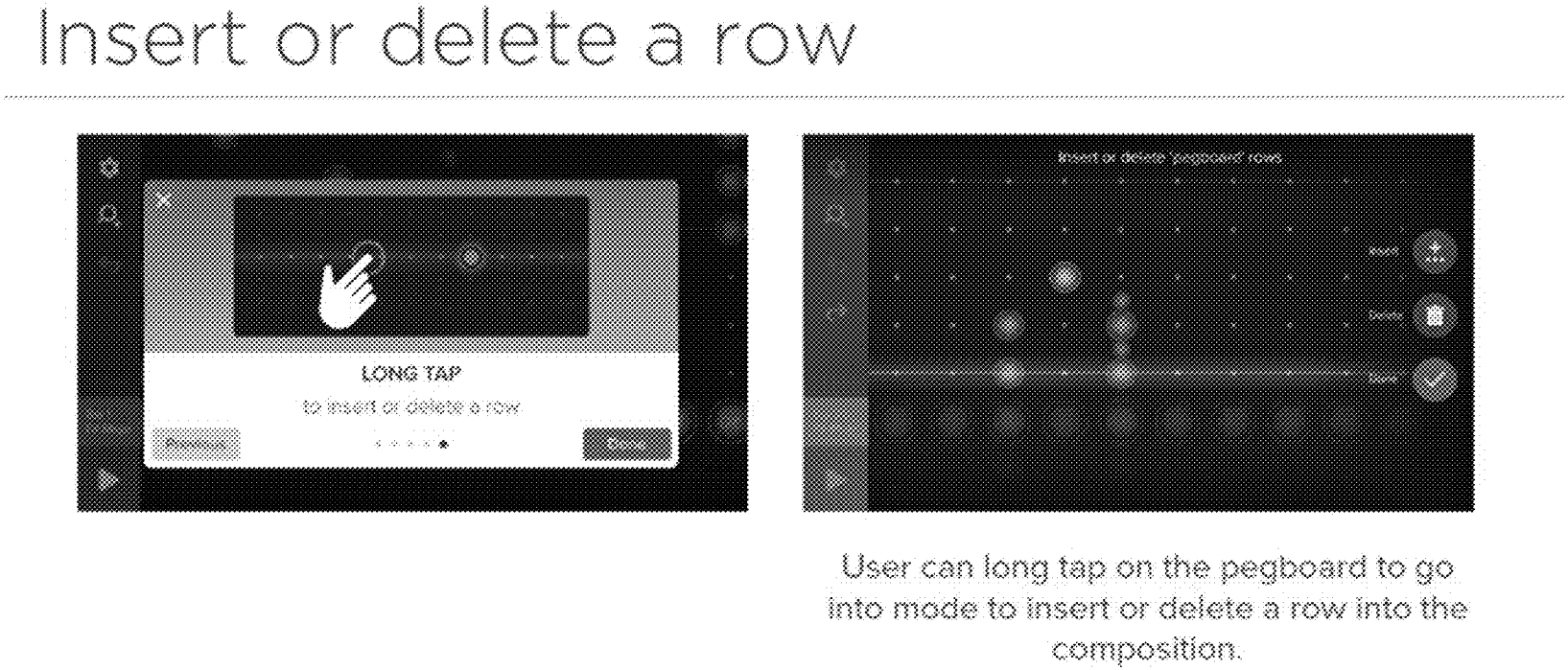
Figure 21:
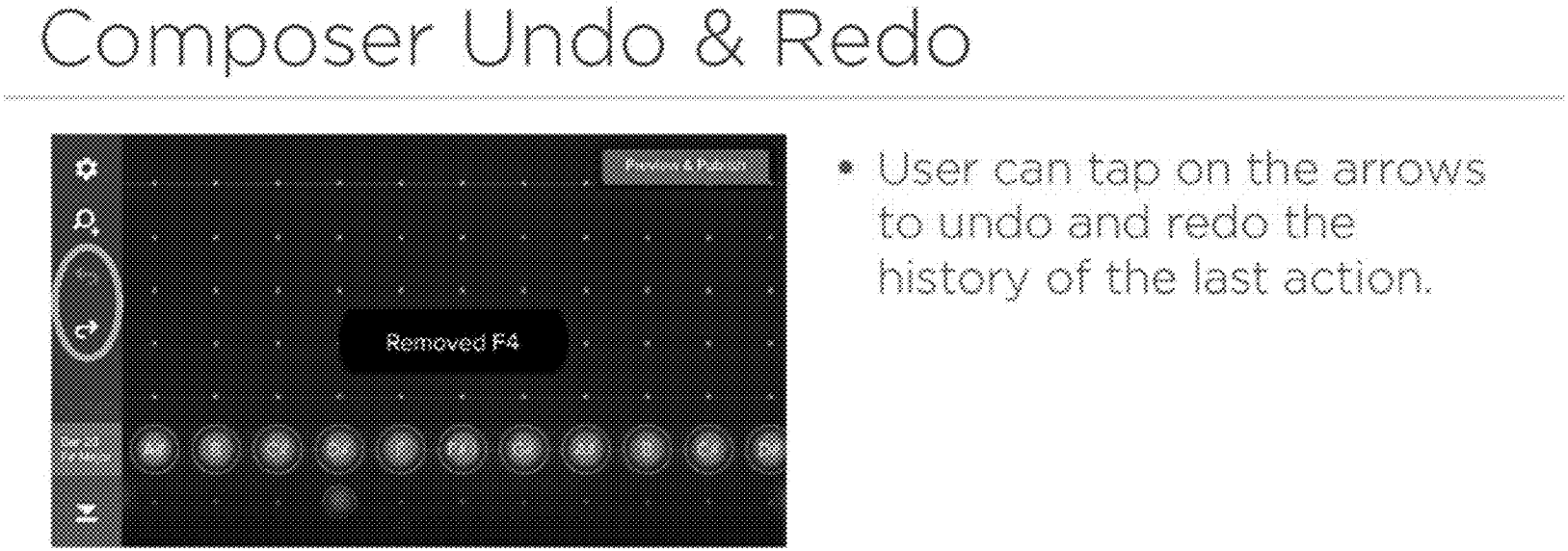

FIGS. 14 and 15 depict a zoomed out composer mini-map view of a musical composition being authored or edited in a musical composition mode operation in accordance with some embodiments of the present invention, together with an exemplary user interface gesture to select the composer mini-map view. FIG. 16 depicts composer settings. FIG. 18 depicts insertion into, and deletion from, a musical composition being authored or edited in a musical composition mode operation in accordance with some embodiments of the present invention, together with an exemplary user interface gesture to select the insert/delete options. FIG. 20 visually depicts composer preview and publish modes, while FIG. 21 visually depicts undo/redo controls of the illustrated user interface.

Figure 22:
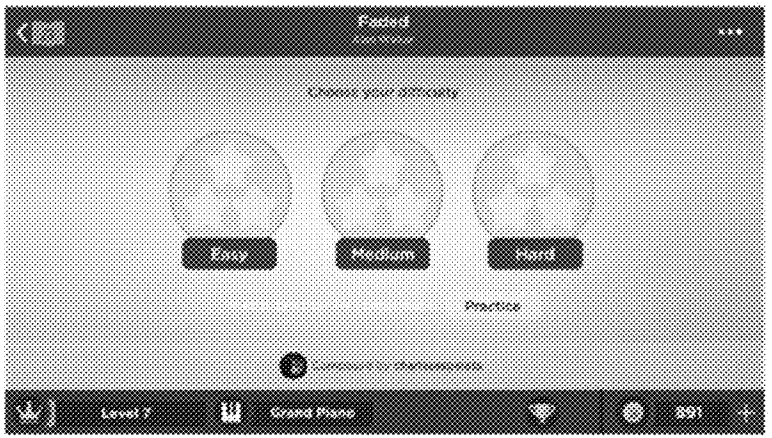
Figure 24:
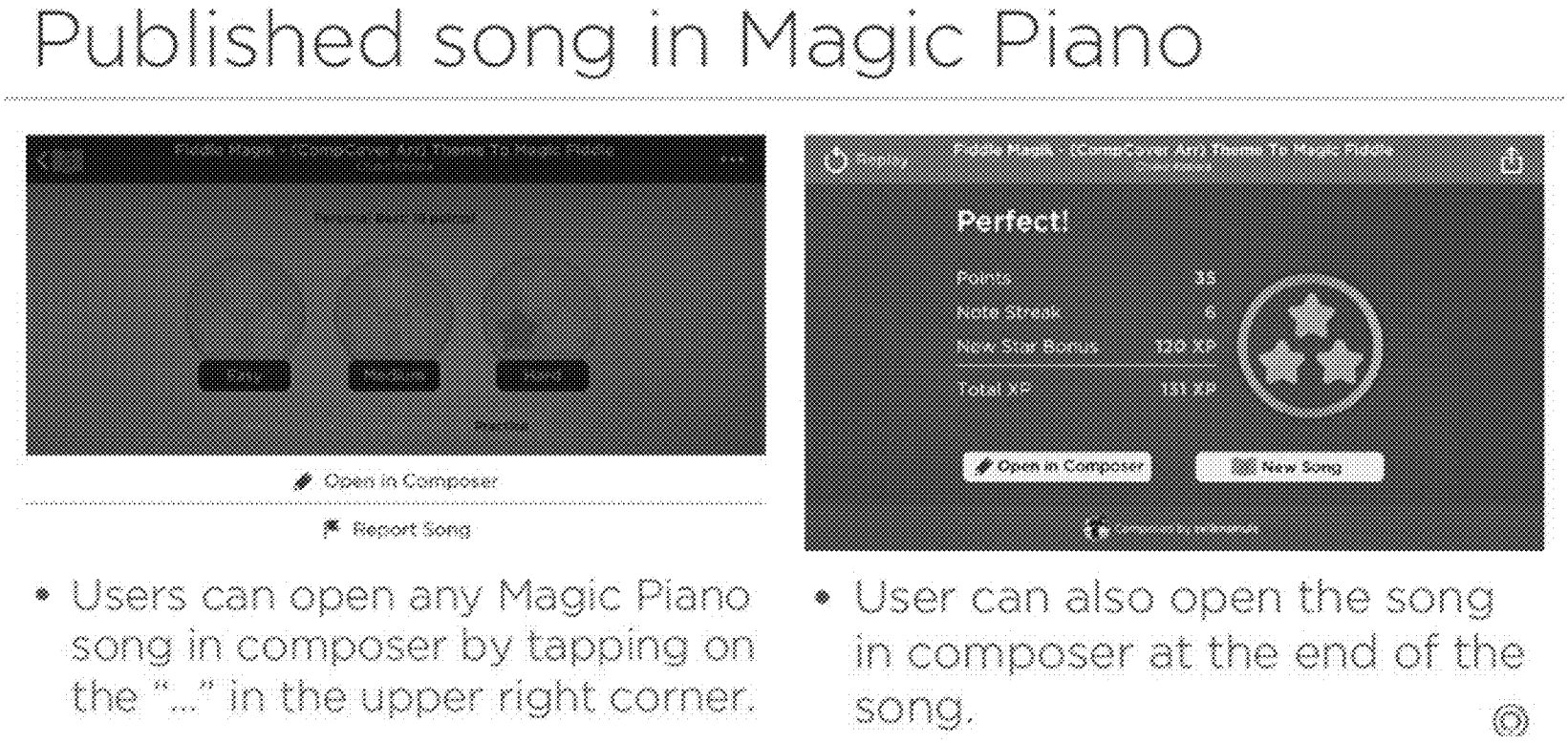

FIGS. 22, 23 and 24 depict publication to a social music network or community of the musical composition that has been authored or edited in a musical composition mode such as described above. In some cases or embodiments in accordance with the present invention, publication is by upload to a content server or service platform such as that illustrated in FIGS. 5 and 6.

Figure 25:
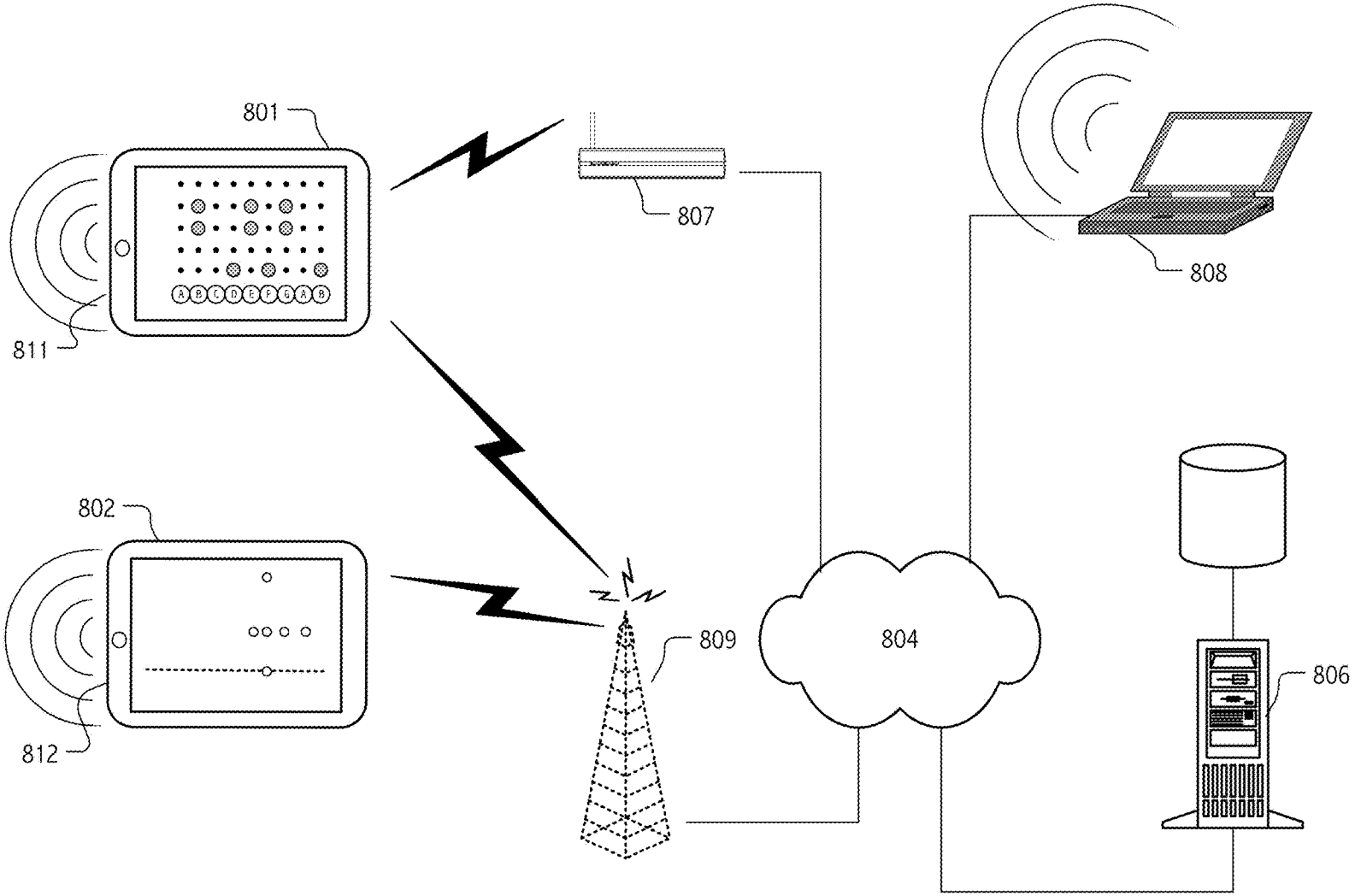

FIG. 25 is a network diagram that illustrates cooperation of certain exemplary devices, including devices used for musical composition authorship/editing and devices used for musical performances based on authored/edited content, all in accordance with some embodiments, uses or deployments of the present invention(s). Note that in some cases, the same device (and perhaps user) may be involved in authorship/editing of particular content and in musical performance thereof though, more generally, a large and interconnected community of authors and performers produce and consume musical score content.

Skilled artisans will appreciate that elements or features in the figures are illustrated for simplicity and clarity and have not necessarily been drawn to scale. For example, the dimensions or prominence of some of the illustrated elements or features may be exaggerated relative to other elements or features in an effort to help to improve understanding of embodiments of the present invention.

Variations and Other Embodiments

While the invention(s) is (are) described with reference to various embodiments, it will be understood that these embodiments are illustrative and that the scope of the invention(s) is not limited to them. Many variations, modifications, additions, and improvements are possible. For example, while a synthetic piano implementation has been used as an illustrative example, variations on the techniques described herein for other synthetic musical instruments such as string instruments (e.g., guitars, violins, etc.) and wind instruments (e.g., trombones) will be appreciated. Furthermore, while certain illustrative processing techniques have been described in the context of certain illustrative applications, persons of ordinary skill in the art will recognize that it is straightforward to modify the described techniques to accommodate other suitable signal processing techniques and effects.

Embodiments in accordance with the present invention may take the form of, and/or be provided as, a computer program product encoded in a machine-readable medium as instruction sequences and other functional constructs of software, which may in turn be executed in a computational system (such as a iPhone handheld, mobile device, portable computing device or other system) to perform methods described herein. In general, a machine readable medium can include tangible articles that encode information in a form (e.g., as applications, source or object code, functionally descriptive information, etc.) readable by a machine (e.g., a computer, computational facilities of a mobile device or portable computing device, etc.) as well as tangible storage incident to transmission of the information. A machine-readable medium may include, but is not limited to, magnetic storage medium (e.g., disks and/or tape storage); optical storage medium (e.g., CD-ROM, DVD, etc.); magneto-optical storage medium; read only memory (ROM); random access memory (RAM); erasable programmable memory (e.g., EPROM and EEPROM); flash memory; or other types of medium suitable for storing electronic instructions, operation sequences, functionally descriptive information encodings, etc.

In general, plural instances may be provided for components, operations or structures described herein as a single instance. Boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention(s).

What is claimed is:

1. An apparatus comprising:

a portable computing device having a multi-touch sensitive display, a network communications interface and both (i) a musical composition authoring process and (ii) digital synthesis executable thereon to audibly render at an audio interface of the portable computing device coded musical arrangements, including in a course of musical composition authoring by a human user, the musical composition authoring process executable to present on the multi-touch sensitive display a two-dimensional grid of note soundings wherein musical scale is presented thereon in a first dimension and measure or time is presented in a second dimension generally orthogonal to the first dimension, wherein the coded musical arrangements are conveyed, via the network communications interface, to and from a content server- or service platform-resident songbook to provide community contributed content in a social music network that includes the portable computing device and the human user, wherein visual presentation on the multi-touch sensitive display of a particular coded musical arrangement being authored or edited by the human user is in accordance with a current musical scale, and wherein a user interface of the musical composition authoring process supports user interface gestures whereby the human user, in the course of musical composition authoring, switches between a first musical scale presentation mode and at least a second musical scale presentation mode.

2. An apparatus as in claim 1, wherein the first dimension is a horizontal dimension and the second dimension is a vertical dimension.

3. An apparatus as in claim 2, wherein, in the first musical scale presentation mode, the note soundings of the coded musical arrangement are visually presented in accordance with a diatonic scale, wherein, in the second musical scale presentation mode, the note soundings of the coded musical arrangement are visually presented in accordance with a chromatic scale, and wherein the user interface gestures include generally horizontally-oriented reverse pinch and pinch gestures on the multi-touch sensitive display to reveal and hide additional notes of the chromatic scale.

4. An apparatus, as in claim 1, configured as a synthetic musical instrument, wherein the digital synthesis is of piano-type string excitations gestured by the human user on the multi-touch sensitive display, wherein the first musical scale is a diatonic scale anchored in a user selectable major or minor key, and wherein the second musical scale is a chromatic scale.

5. An apparatus as in claim 1, further comprising:

a user interface that presents the human user with a play control to trigger, upon selection thereof, the digital synthesis and an audible rendering of a particular coded musical arrangement being authored or edited by the human user.

6. An apparatus as in claim 1, wherein a visual presentation of the two-dimensional grid on the multi-touch sensitive display includes a keying band that presents individual key positions in accordance with a current musical scale.

7. An apparatus comprising:

a portable computing device having a multi-touch sensitive display, a network communications interface and both (i) a musical composition authoring process and (ii) digital synthesis executable thereon to audibly render at an audio interface of the portable computing device coded musical arrangements, including in a course of musical composition authoring by a human user, the musical composition authoring process executable to present on the multi-touch sensitive display a two-dimensional grid of note soundings wherein musical scale is presented thereon in a first dimension and measure or time is presented in a second dimension generally orthogonal to the first dimension, wherein the coded musical arrangements are conveyed, via the network communications interface, to and from a content server- or service platform-resident songbook to provide community contributed content in a social music network that includes the portable computing device and the human user, wherein visual presentation of the two-dimensional grid on the multi-touch sensitive display includes a composer pegboard that presents notes sounded or to be sounded in prior measures of a particular coded musical arrangement in correspondence with pegboard positions aligned with a current musical scale.

8. An apparatus as in claim 7, wherein a user interface of the musical composition authoring process supports user interface gestures on the multi-touch sensitive display whereby generally vertically-oriented reverse pinch and pinch gestures on the multi-touch sensitive display adjust the visual presentation amongst plural measures of musical meter, including bar and fractionally quantized measures thereof.

9. An apparatus as in claim 7, wherein a user interface of the musical composition authoring process supports a tap-denominated user interface gesture on the multi-touch sensitive display whereby the human user inserts or deletes one or more measures of the coded musical arrangement.

10. An apparatus as in claim 7, wherein a user interface of the musical composition authoring process supports lateral swiping gesture on the multi-touch sensitive display to shift up and down a current musical scale to reveal higher and lower octaves thereof.

11. An apparatus as in claim 7, configured as a synthetic musical instrument, wherein the synthetic musical instrument is communicatively coupled to the content server- or service platform-resident songbook.

12. An apparatus as in claim 7, wherein at least some of the coded musical arrangements are MIDI coded.

13. A system comprising:

a content server- or service platform-resident repository of community contributed musical scores, the repository coupled via one or more communications networks to define a social music network that includes a plurality of portable computing devices configured as synthetic musical instruments, wherein at least a first one of the synthetic musical instruments include:

a multi-touch sensitive display;

a network communications interface; and both (i) a musical composition authoring process and (ii) digital synthesis executable thereon to audibly render coded musical arrangements at an audio interface of the portable computing device, including in a course of musical composition authoring by a human user, wherein the musical composition authoring process is executable to present on the multi-touch sensitive display a two-dimensional grid of note soundings, wherein musical scale is presented thereon in a first dimension and measure or time is presented in a second dimension generally orthogonal to the first dimension, wherein the musical composition authoring process is further executable to support a retrieve/modify/post interaction with the network-coupled repository, and wherein the network-coupled repository maintains versioning metadata at least in correspondence with postings of musical score instances that are modified from a retrieved musical score instance.

14. The system of claim 13, the synthetic musical instruments configured to retrieve and post musical score instances from and to the network-coupled repository; and the network-coupled repository further maintaining metadata in association with the musical score instances, wherein for at least some of the musical score instances, the associated metadata includes crowd-sourced rating or ranking data accumulated from postings by respective users of synthetic musical instruments in connection with audible rendering of the particular musical score instance at an audio interface of the respective portable computing device.

15. The system of claim 13, wherein the first synthetic musical instrument implements a piano.

16. The system of claim 15, further comprising:

at least one non-piano synthetic musical instrument configured to retrieve musical score instances from the community contributed musical scores repository, including musical score instances authored or edited on, and posted by, the first synthetic musical instrument.

17. The system of claim 15, further comprising:

at least one portable computing device configured for karaoke-style vocal capture and network coupled to retrieve musical score instances from the community contributed musical scores repository, including musical score instances authored or edited on, and posted by, the first synthetic musical instrument.

18. A method comprising:

visually presenting on a multi-touch sensitive display of a portable computing device, a two-dimensional grid of constituent note soundings of a coded musical arrangement, wherein musical scale is presented thereon in a first dimension and measure or time is presented in a second dimension generally orthogonal to the first dimension, wherein the visual presentation of the two-dimensional grid on the multi-touch sensitive display includes a composer pegboard that presents notes sounded or to be sounded in prior measures of a particular coded musical arrangement in correspondence with pegboard positions aligned with a current musical scale;

in a course of musical composition authoring or revising the coded musical arrangement, digitally synthesizing an audible rendering of at least a portion of the coded musical arrangement at an audio interface of the portable computing device; and posting the authored or revised coded musical arrangement, via a network communications interface of the portable computing device, to a content server- or service platform-resident songbook to provide community contributed content in a social music network that includes the portable computing device.

19. The method of claim 18, further comprising:

via the network communications interface of the portable computing device, retrieving a precursor version of the coded musical arrangement from the content server- or service platform-resident songbook.

20. A method comprising:

visually presenting on a multi-touch sensitive display of a portable computing device and in accordance with a current musical scale, a two-dimensional grid of constituent note soundings of a coded musical arrangement being authored or edited by a human user, wherein musical scale is presented thereon in a first dimension and measure or time is presented in a second dimension generally orthogonal to the first dimension; and in a course of musical composition authoring or revising the coded musical arrangement, digitally synthesizing an audible rendering of at least a portion of the coded musical arrangement at an audio interface of the portable computing device;

responsive to user interface gestures of the human user, switching in the course of the musical composition authoring or revising, between a first musical scale presentation mode and at least a second musical scale presentation mode; and posting the authored or revised coded musical arrangement, via a network communications interface of the portable computing device, to a content server- or service platform-resident songbook to provide community contributed content in a social music network that includes the portable computing device.

21. The method of claim 20, wherein, in the first musical scale presentation mode, the note soundings of the coded musical arrangement are visually presented in accordance with a diatonic scale, wherein, in the second musical scale presentation mode, the note soundings of the coded musical arrangement are visually presented in accordance with a chromatic scale, and wherein the user interface gestures include reverse pinch and pinch gestures on the multi-touch sensitive display to reveal and hide additional notes of the chromatic scale.

22. The method of claim 20, wherein the digital synthesis is of piano-type string excitations, wherein the first musical scale is a diatonic scale anchored in a user selectable major or minor key, and wherein the second musical scale is a chromatic scale.

23. The method of claim 18, further comprising:

presenting the human user with a play control to trigger, upon selection thereof, the digital synthesis and an audible rendering of a particular coded musical arrangement being authored or edited.

24. The method of claim 18, wherein the visual presentation of the two-dimensional grid on the multi-touch sensitive display includes a keying band that presents individual key positions in accordance with a current musical scale.

25. The method of claim 18, further comprising:

responsive to generally vertically-oriented reverse pinch and pinch gestures of the human user on the multi-touch sensitive display, adjusting the visual presentation amongst bar and fractionally quantized measures of musical meter.

26. The method of claim 18, further comprising:

responsive to a tap-denominated user interface gesture on the multi-touch sensitive display inserting or deleting one or more measures of the coded musical arrangement.

27. The method of claim 18, further comprising:

responsive to a swiping gesture on the multi-touch sensitive display shifting up and down a current musical scale to reveal higher and lower octaves thereof.

28. A musical composition authoring system comprising:

a content server- or service platform-resident repository of community contributed musical scores, the repository coupled via one or more communications networks to define a social music network that includes a plurality of portable computing devices configured as synthetic musical instruments; and a composer client including a retrieval and posting interface to the community-contributed musical scores, the composer client configured to (i) present a human composer with a two-dimensional grid of note sounding positions wherein musical scale is presented thereon in a first dimension and measure or time is presented in a second dimension generally orthogonal to the first dimension and to (ii) overlay on the two-dimensional grid a visual presentation of at least a current window on a coded musical score being authored or edited by the human user, wherein the network-coupled repository is configured to maintain versioning metadata at least in correspondence with postings of musical score instances that are modified from a retrieved musical score instance.

29. The system of claim 28, wherein, in a first mode, the note soundings of the coded musical score are visually presented in accordance with a diatonic scale, wherein, in a second mode, the note sounding positions are visually presented in accordance with a chromatic scale, and wherein, in correspondence with transitions between the first and second modes, the composer client reveals and hides additional notes of the chromatic scale.

30. The system of claim 28, further comprising:

the synthetic musical instruments, wherein the synthetic musical instruments are configured to retrieve and post musical score instances from and to the network-coupled repository, and wherein the network-coupled repository is configured to maintain metadata in association with the musical score instances, wherein for at least some of the musical score instances, the associated metadata includes crowd-sourced rating or ranking data accumulated from postings by respective users of synthetic musical instruments in connection with audible rendering of the particular musical score instance at an audio interface thereof.

31. The system of claim 28, further comprising:

a karaoke-style vocal capture device that is network coupled to retrieve musical score instances from the community contributed musical scores repository, including musical score instances authored or edited on, and posted by, the composer client.

* * * * *